US006176351B1

(12) United States Patent
Ikeda et al.

(10) Patent No.: US 6,176,351 B1
(45) Date of Patent: Jan. 23, 2001

(54) DOUBLE DECK ELEVATOR ALLOCATION CONTROLLING APPARATUS

(75) Inventors: Tetsuji Ikeda, Fuchu; Mitsuyo Yamaura, Machida; Kazuyuki Sakakibara, Fuchu, all of (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/218,075

(22) Filed: Dec. 22, 1998

(30) Foreign Application Priority Data

Dec. 26, 1997 (JP) ..... 9-366953
Jan. 14, 1998 (JP) ..... 10-017672

(51) Int. Cl.[7] ..... B66B 5/06
(52) U.S. Cl. ..... 187/387; 187/902
(58) Field of Search ..... 187/380, 382, 187/383, 385, 386, 387, 389, 902

(56) References Cited

U.S. PATENT DOCUMENTS 3,625,311 * 12/1971 Nowak et al. ..... 187/29 R
4,632,224 * 12/1986 Nowak et al. ..... 187/29 R
4,838,385 * 6/1989 Ekholm ..... 187/101
5,107,962 * 4/1992 Ekholm ..... 187/16
5,663,539 * 9/1997 Powell et al. ..... 187/385
5,865,274 2/1999 Kiji et al. .

FOREIGN PATENT DOCUMENTS 48-67944 9/1973 (JP) .
8-73138 * 3/1996 (JP) .
10-212078 * 8/1998 (JP) .
11-60086 * 3/1999 (JP) .

* cited by examiner

*Primary Examiner*—Jonathan Salata
(74) *Attorney, Agent, or Firm*—Oblon, Spivak, McClelland, Maier & Neustadt, P.C.

(57) ABSTRACT

An controlling apparatus for a double deck elevator is disclosed. An allocation control unit (5), when a predetermined specified floor is registered in an elevator hall call registering unit (4) in a double operation mode, makes both of upper and lower cages of each double deck elevator respond thereto. Each cage call registering unit (9) is capable of registering a cage call to both of the upper and lower cages in the double operation mode as far as the specified floor is concerned. An operation control unit (8) in each elevator controls operations of the upper and lower cages to respond to the elevator hall call to the specified floor which is allocated by the allocation control unit (5) and to a cage call to the specified floor which is registered in the cage call registering unit (9).

11 Claims, 21 Drawing Sheets

DOUBLE DECK ELEVATOR ALLOCATION CONTROLLING APPARATUS

BACKGROUND OF THE INVENTION

1. Field of the Invention

The present invention relates to a double deck elevator controlling apparatus for performing group supervisory control of a plurality of double deck elevators each having upper and lower cages connected to each other.

2. Discussion of the Background

A double deck elevator is constructed so that upper and lower cages are vertically connected to each other, and each cage is capable of responding to a call. Therefore, the call for one cage exerts influences on a call for the other cage, resulting in such a situation that the other cage must uselessly halt. Such being the case, some kinds of operation modes are predetermined in order to obviate the useless halts as much as possible, and one of such operations modes is properly selected. In general, to be specific, a double operation mode, a single operation mode and a semi-double operation mode are known as the above operation modes.

In the double operation mode the upper cage gives services responding to elevator hall calls to even-numbered floors, and the lower cage gives services responding to elevator hall calls to odd-numbered floors. In the single operation mode one cage is closed, and only the upper or lower cage gives the services for the calls irrespective of the even-numbered or odd-numbered floors. Further, in the semi-double operation mode is that passengers wishing to go to the even-numbered floors are allowed to get on the upper cage only at a start base floor, while the passengers wishing to go to the odd-numbered floors are allowed to get on the lower cage thereat, and both of the upper and lower cages can stop at an arbitrary floor after leaving the start base floor. Those operation modes are so operated as to be switched over corresponding to a time zone, taking into consideration the number of passengers and a moving direction etc.

Mainly in the semi-double operation mode, a variety of operating systems have hitherto been proposed for the purpose of enhancing an operation efficiency. For example, there is a system, wherein when the elevator is lifted, the service cage is set to the lower cage, and, when lowered, the service cage is set to the upper cage. If there is an allocation of the elevator hall call to the floor of the non-service cage when responded, the allocation is changed, and a simultaneous response is made. In another system if the upper and lower cages are incapable of simultaneously responding to the call when the elevator hall call occurs, the allocation of the elevator hall call occurred is reserved and held for a fixed period of time, and a reservation guide is released immediately when the upper and lower cages become capable of simultaneously responding due to a call addition thereafter. Furthermore, there is developed a system for not only taking the simultaneous response into consideration when the elevator hall call occurs, but also reviewing the allocation between the upper and lower cages to perform the simultaneous response with the addition of the cage call or of the elevator hall calls to other floors after allocating the elevator hall call.

The prior art controlling apparatus is, however, merely constructed so that the simultaneous response is made by controlling the allocation of the elevator hall call when performing the semi-double operation. Namely, the passenger sets a call to an arbitrary floor with respect to the cage call, and nevertheless no control considering the simultaneous response is implemented in the operations excluding the semi-double operation. Further, during the double operation, the passenger selects the elevator on which the passenger can get and therefore must walk up along a staircase to the even-numbered or odd-numbered floor, which might give some burden upon the passenger.

In particular, the elevator services concentrate at only a dining-hall floor at a lunch time. Therefore, during the double operation, the floors from which to go directly to the dining-hall floor and the floors from which the elevator is unable to go directly, are set by classifying the even-numbered floors and the odd-numbered floors, thus deconcentrating the elevator services. This contrivance, however, although capable of deconcentrating the elevator services, conduces to such a situation that the passengers on the floors coming under one classification invariably must walk along the staircase. This being the case, at the lunch time, the semi-double operation is often conducted involving some decline in the operation efficiency.

On the other hand, with a spread of higher-rise buildings, the double deck elevators have recently been adopted in terms of enhancing a transporting capability, and consequently group supervisory control of the plurality of double deck elevators are implemented. Normally, in the group supervisory control of the elevators, when the elevator hall call is registered, an allocation evaluation arithmetic process is executed upon each of the elevators on the basis of a time required till the elevator arrives at a calling floor, and a cage to which the elevator hall call is allocated is determined based on this arithmetic result.

Further, in the operation of the elevator, there might be performed an operation mode (which is hereinafter referred to as a "reciprocating operation") in which the elevator stops only at two specified floors considerably away from each other and travels non-stop past the other floors. In the case of performing this reciprocating operation, the plurality of elevators are classified into reciprocating elevators and normal operation elevators, the reciprocating operation is applied to only the elevators classified as the reciprocating elevators. This reciprocating operation is utilized especially in such a case that a multiplicity of passengers are transported in concentration to only the specified floors. The reciprocating operation is applied to such a case that, for example, an entrance hall floor is set as a start base floor, a restaurant floor or an event floor is set as an arrival base floor, and the elevator travels non-stop therebetween. In the prior art group supervisory control of the double deck elevators, no special allocation control system is adopted on the occasion of the reciprocating operation.

Moreover, in the prior art controlling apparatus for the double deck elevator, when performing the reciprocating operation, the allocation evaluation arithmetic process base on the arrival time is executed upon each elevator upon registering the elevator hall call, and the cage to which the elevator hall call is allocated is determined based on this arithmetic result. Therefore, a useless stop might occur in spite of the reciprocating operation. That is, there might arise a case in which the useless halt occurs due to the stop of the other cage of the same elevator, which gives a feeling of irritation to the passengers. Further, a problem is that the elevator does not necessarily have a good usability.

SUMMARY OF THE INVENTION

It is a primary object of the present invention to provide a controlling apparatus for a double deck elevator which is capable of performing a more efficient operation if demands concentrate at a specified floor and of enhancing a serviceability for passengers.

It is another object of the present invention to provide a controlling apparatus for a double deck elevator which is capable of attaining a smoother reciprocating operation by obviating a useless stop of a cage, and of enhancing a usability by a user.

To accomplish the above objects, according to a first aspect of the present invention, a double deck elevator controlling apparatus for executing group supervisory control of a plurality of double deck elevators each containing upper and lower cages vertically connected to each other, comprises an elevator hall call registering unit for registering elevator hall calls given from elevator hall call buttons in up- and down-directions which are provided at respective elevator halls on respective floors, an allocation control unit for making both of the upper and lower cages respond to an elevator hall call to a specified floor which meets a predetermined condition during an operation in a double operation mode of giving services of the upper cages in response to the elevator hall calls at even-numbered floors and giving services of the lower cages in response to the elevator hall calls at odd-numbered floors, a c(age call registering unit provided each of the double deck elevators and possible of registering the cage calls of both of the upper and lower cages during the operation in the double operation mode as far as the specified floor is concerned, and an operation control unit for operating the upper and lower cages so as to respond to the elevator hall call to the specified floor which is allocated by the allocation control unit and to the cage call to the specified floor which is registered in the cage call registering unit.

According to this first aspect, simultaneous responses to the cage calls for the upper and lower cages are made with respect to a dining-hall floor (the specified floor) at an operation time such as a lunch time, and hence the elevator hall calls to the dining-hall floor are allocated to the upper and lower cages. Then, there is implemented such control that the passengers going to the even-numbered floors get on the upper cage, and the passengers going to the odd-numbered floors get on the lower cage, whereby both of the upper and lower cages are allowed to go to the dining-hall floor. It is therefore feasible to perform the operation control at a high efficiency without deteriorating the serviceability for the passengers.

According to a second aspect of the present invention, a double deck elevator controlling apparatus executes group supervisory control of a plurality of double deck elevators each containing upper and lower cages vertically connected to each other, wherein one of the plurality of double deck elevators is set as a reciprocating elevator reciprocating between specified floors, and traveling of the reciprocating elevator is controlled between one specified floors constructed of two consecutive floors and the other specified floor constructed of only one floor. The controlling apparatus comprises an elevator hall call registering unit for registering elevator hall calls to the respective floors including the specified floors, an allocation control unit for allocating the elevator hall call to the specified floor to the upper or lower cage, with a cage call to the specified floor, of the reciprocating elevator when the elevator hall call to the specified floor is registered in the elevator hall call registering unit, executing a predetermined arithmetic process upon the upper cage and the lower cage when there is no cage call to the specified floor, and allocating the elevator hall call to the cage exhibiting a high evaluation value, and an operation control unit, provided in each of the elevators, for controlling the traveling of the cage so as to respond to the call allocated by the allocation control unit.

According to the second aspect, in the case of the so-called reciprocating operation between the specified floors, there is obtained the arithmetic result of the allocation evaluation arithmetic process with respect to the call to the specified floor, and besides the predetermined allocating process for the reciprocating operation between the specified floors is executed. It is therefore possible to obviate the useless halt by increasing an opportunity for increasing the simultaneous response of the cage. This makes it feasible to attain a smoother reciprocating operation and improve the usability by the user.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENTS OF THE INVENTION

Embodiments of the present invention will hereinafter be described with reference to the accompanying drawings.

Figure 1:
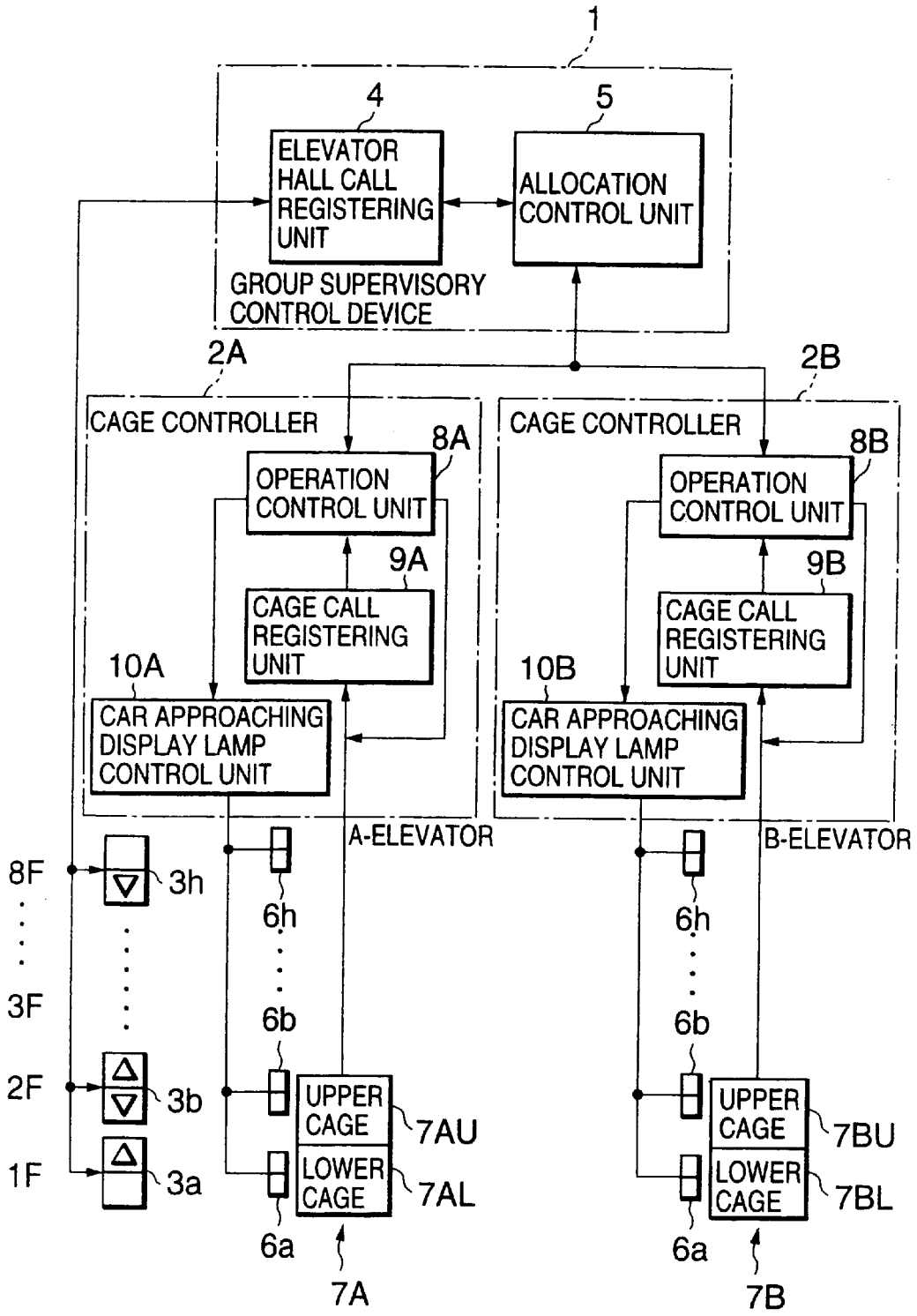
FIG. 1 is a block diagram showing a controlling apparatus for a double deck elevator in a first embodiment of the present invention.

FIG. 1 is a block diagram of a controlling apparatus for a double deck elevator in a first embodiment of the present invention. It is assumed in the following discussion that two double deck elevators are installed in an 8-storied building, a start base floor as a specified floor is set to a first entrance floor, and an arrival base floor is set to a third dining-hall floor. Then, as a predetermined condition of the specified floor is an assumption that a demand for the third dining-hall floor increases at a lunch time.

As shown in FIG. 1, two double deck elevators 7A, 7B respectively include upper cages 7AU, 7BU and lower cages 7AL, 7BL which accommodate passengers, and controllers 2A, 2B are provided for the respective double deck elevators 7A, 7B. In the double deck elevators 7A, 7B, the upper cages 7AU, 7BU and the lower cages 7AL, 7BL are vertically connected to each other, and hence both of the cages integrally run invariably in a lifting direction or in a lowering direction. Further, elevator halls of the floors 1F, 2F, . . . , 8F are provided with hall call buttons 3*a*, 3*b*, . . . , 3*h*, and the double deck elevators 7A, 7B are provided with car approaching display lamps 6*a*–6*h* for informing the passengers of which (number of) elevator responds to a call.

A group supervisory control device 1 is provided in common for the cage controllers 2A, 2B. The group supervisory control device 1 includes a hall call registering unit 4 and an allocation control unit 5. When any one of the hall call buttons 3*a*,–3*h* is pressed, this operation is inputted and registered as a hall call in the hall call registering unit 3. The hall call registering unit 4, upon detecting an occurrence of the hall call, informs the allocation control unit 5 of a piece of detection information. The allocation control unit 5 receives cage call information and running states of the respective elevators 7A, 7B from the cage controllers 2A, 2B, and sends a hall call allocation to the controller 2A or 2B of the elevator exhibiting the highest evaluation value (the shortest prediction arrival time) among evaluation values based on a prediction time (prediction arrival time) till the elevator arrives. Herein, in the case of executing, e.g., a double operation, allocation cages (of even-numbered and odd-numbered floors) of the elevator A or B are allocated.

The cage controllers 2A, 2B respectively have operation control units 8A, 8B, cage call registering units 9A, 9B, and car approaching display lamp control units 10A, 10B. The hall call allocation information given from the allocation control unit 5 of the group supervisory control device 1, is received by the operation control units 8A, 8B, whereby one corresponding lamp among the car approaching display lamps 6*a*–6*h* is lit up through the car approaching display lamp control units 10A, 10B. Further, when the cage call is registered in the upper cage 7AU (or 7BU) or the lower cage 7AL (or 7BL), the cage call registering units 9A, 9B transfer the cage call registration information to the operation control units 8A, 8B. Then, the operation control units 8A, 8B determine a next stop floor on the basis of the hall call allocation information and the call registration information, and let the upper cage 7AU (or 7BU) or the lower cage 7AL (or 7BL) run toward the stop floor.

Figure 2:
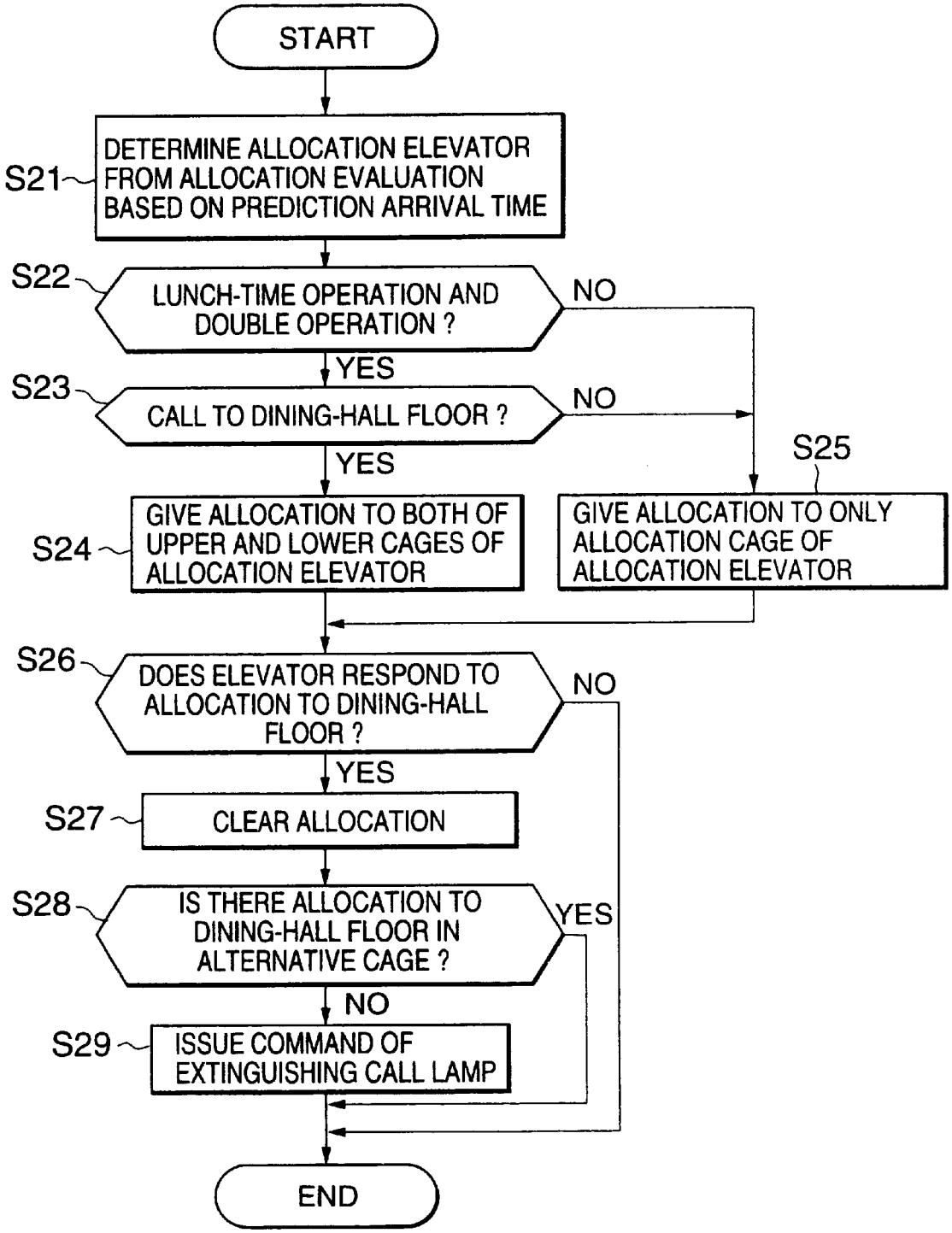
FIG. 2 is a flowchart showing an operation of an allocation control unit in the controlling apparatus shown in FIG. 1.

FIG. 2 is a flowchart showing an operation of the allocation control unit 5 in the first embodiment of the present invention. The allocation control unit 5 starts an allocating operation upon receiving a new piece of hall call registration information from the hall call registering unit 4. To begin with, when receiving the new hall call information, in step S21, the allocation control unit 5 executes an evaluation arithmetic process of the allocation on the basis of the prediction arrival time given from the operation control units 8A, 8B in step S21, and determines the elevator exhibiting the highest evaluation value (the shortest predicted arrival time) as an allocation elevator.

Next, in step S22, the allocation control unit 5 judges whether or not a present operation state indicates "a lunch-time operation and a double operation". If in the lunch-time operation and in the double operation, the allocation control unit 5 judges whether or not the hall call newly registered in step S23 is a call to the dining hall floor (3F). If it is the call to the dining hall floor, the allocation control unit 5 gives in step S24 the allocation of both of the upper and lower cages to the operation control unit 8 of the allocation elevator. If it does not meet the condition in step S22 or S23, the allocation control unit 5 outputs the allocation to only the allocation cage of the allocation elevator in step S25.

Next, the control allocation unit 5 judges whether or not the elevator responds to the allocation to the dining hall floor in step S26, and, when the elevator has responded, clears the allocation in step S27. In step S28, the allocation control unit 5 judges whether or not the allocation to the dining hall floor is given to the other cage, and, if no allocation to the dining hall floor is given to the other cage, gives the hall call registering unit 4 a command of extinguishing the lamp of the hall call button in step S29. If the allocation of the dining hall floor to other cage remains undeleted, the allocation control unit 5 finishes the processing without giving the command of extinction of the hall call lamp. Herein, the other cage indicates the upper cage within the same elevator when considered based on the lower cage, and indicates the lower cage within the same elevator when considered based on the upper cage.

Thus, in the embodiment illustrated in FIGS. 1 and 2, the allocation control unit 5 makes both of the upper and lower cages respond to the elevator hall call to the dining hall floor during the lunch-time operation. When registering, e.g., an upward hall call to, e.g., the third floor, the upper cage responds earlier, and the lower cage responds next. Response lamps of the elevator hall call buttons 3*a*–3*h* are extinguished when the lower cage responds.

Figure 3:
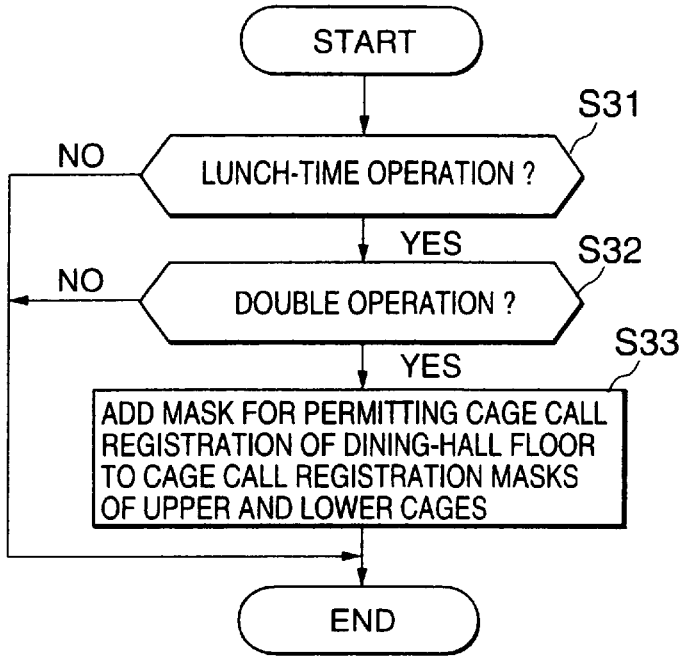
FIG. 3 is a flowchart showing an operation of a cage call registering unit in the controlling apparatus shown in FIG. 1.

FIG. 3 is a flowchart showing operations of the cage call registering units 9A, 9B in the first embodiment. The cage call registering units 9A, 9 judge in step S31 whether or not operation is in the lunch-time operation, and, if in the lunch-time operation, judge in step S32 whether or not in the double operation. Then, if in the lunch-time operation and in the double operation, in step S33, a mask for permitting the cage call registration of the dining hall floor is added to cage call registration masks of the upper and lower cages, and this processing flow comes to an end. Herein, there can be implemented the cage call registration to the dining hall floor (the specified floor) with respect to both of the upper and lower cages. With this operation, when the cage call occurs, only the call, of which the registration is permitted, is registered referring to the mask thereof, and the cage call information is transmitted to the operation control units 8A, 8B. If judged not to be in the lunch-time operation in step S31, or if judged not to be in the double operation in step S32, the processing flow is finished.

Figure 4:
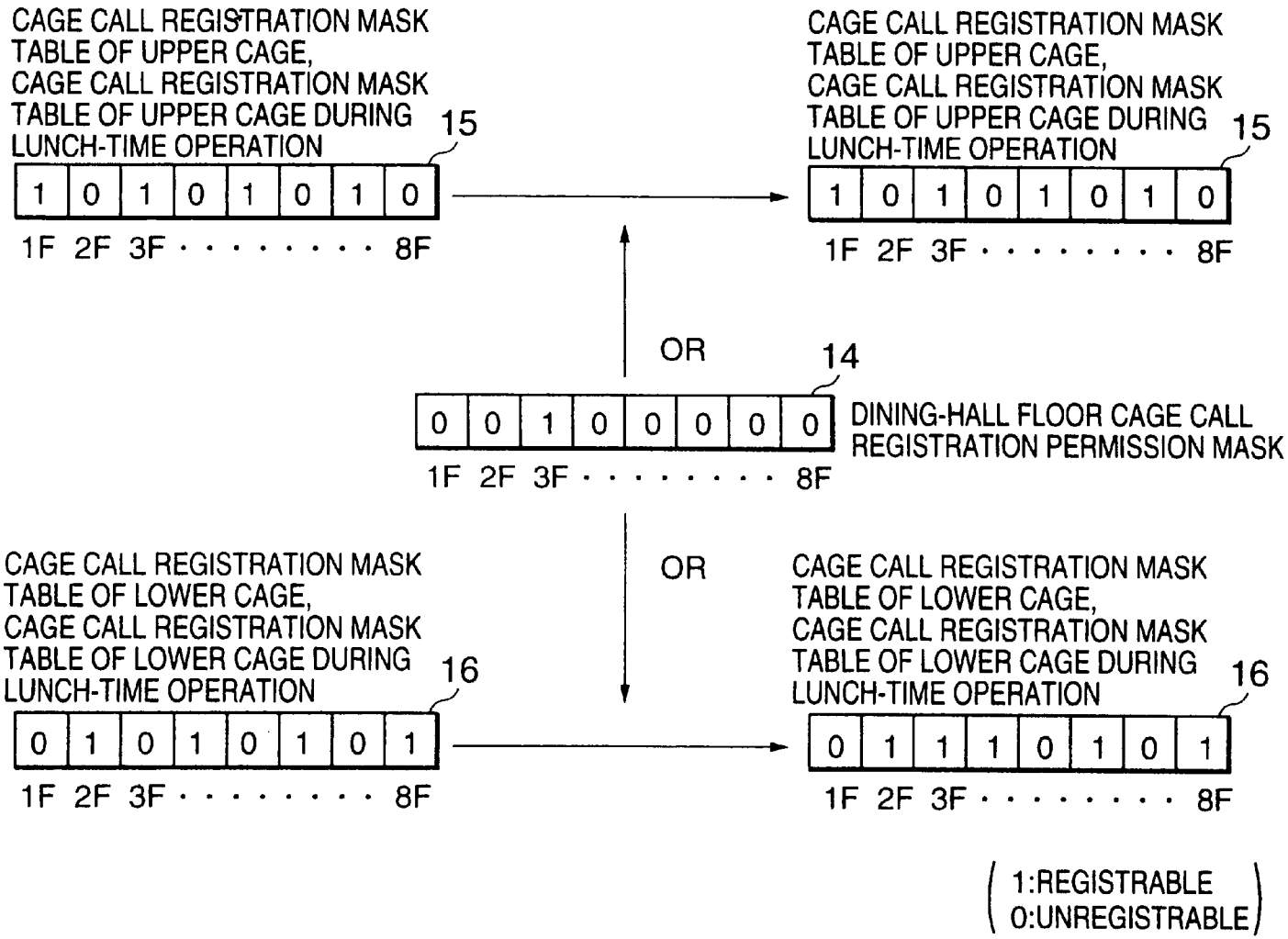
FIG. 4 is an explanatory diagram showing a cage call registration mask table in the controlling apparatus shown in FIG. 1.

FIG. 4 shows an example of a format of a cage call registration mask table. During the lunch-time operation, the cage calls for both of the upper and lower cages to the dining hall floor (the third floor) are permitted, wherein there is used a dining hall cage call registration permission mask 14 of which a permission mask "1" is set to the third floor. In a cage call registration mask table 15 of the upper cages 7AU, 7BU, "1" is set to the odd-numbered floors including 3F at a time excluding the lunch time, and hence no change is made also during the lunch-time operation. By contrast, in a cage call registration mask table 16 of the lower cages 7AL, 7BL, "1" is set to the even-numbered floors such as 2F, 4F etc at a time other than the lunch time. During the lunch-time operation, however, "1" is set to also the third floor in addition to the above. Thus, the cage call registering units 9A, 9B are capable of registering the cage call of both of the upper and lower cages to the dining hall floor during the lunch-time operation.

Figure 5:
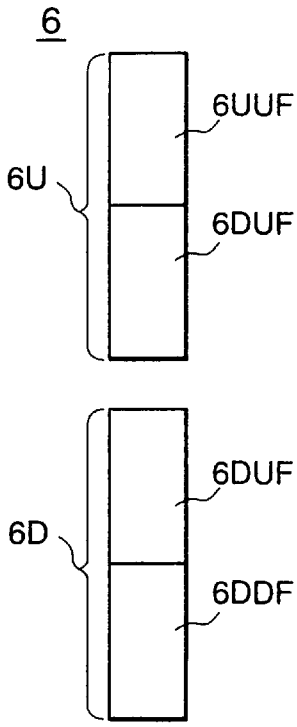
FIG. 5 is an explanatory diagram showing a car approaching a display lamp in the controlling apparatus shown in FIG. 1.

FIG. 5 is an explanatory diagram showing the car approaching display lamps 6*a*–6*h* in the first embodiment. A difference from the ordinary car approaching display lamp is that both of an UP-direction car approaching display lamp area 6U and a DN-(DOWN) direction car approaching display lamp area 6D are vertically halved. To be more specific, the UP-direction car approaching display lamp area 6U is divided into an upper cage UP-landing flicker area 6UUF and a lower cage UP-landing flicker area 6UDF, while the DN-direction car approaching display lamp area 6D is divided into an upper cage DN-landing flicker area 6DUF and a lower cage DN-landing flicker area 6DDF. These car approaching display lamps 6*a*–6*h* are lit up under control of the car approaching display lamp control units 10A, 10B, and operations thereof are conducted based on a flowchart shown in FIG. 6.

Figure 6:
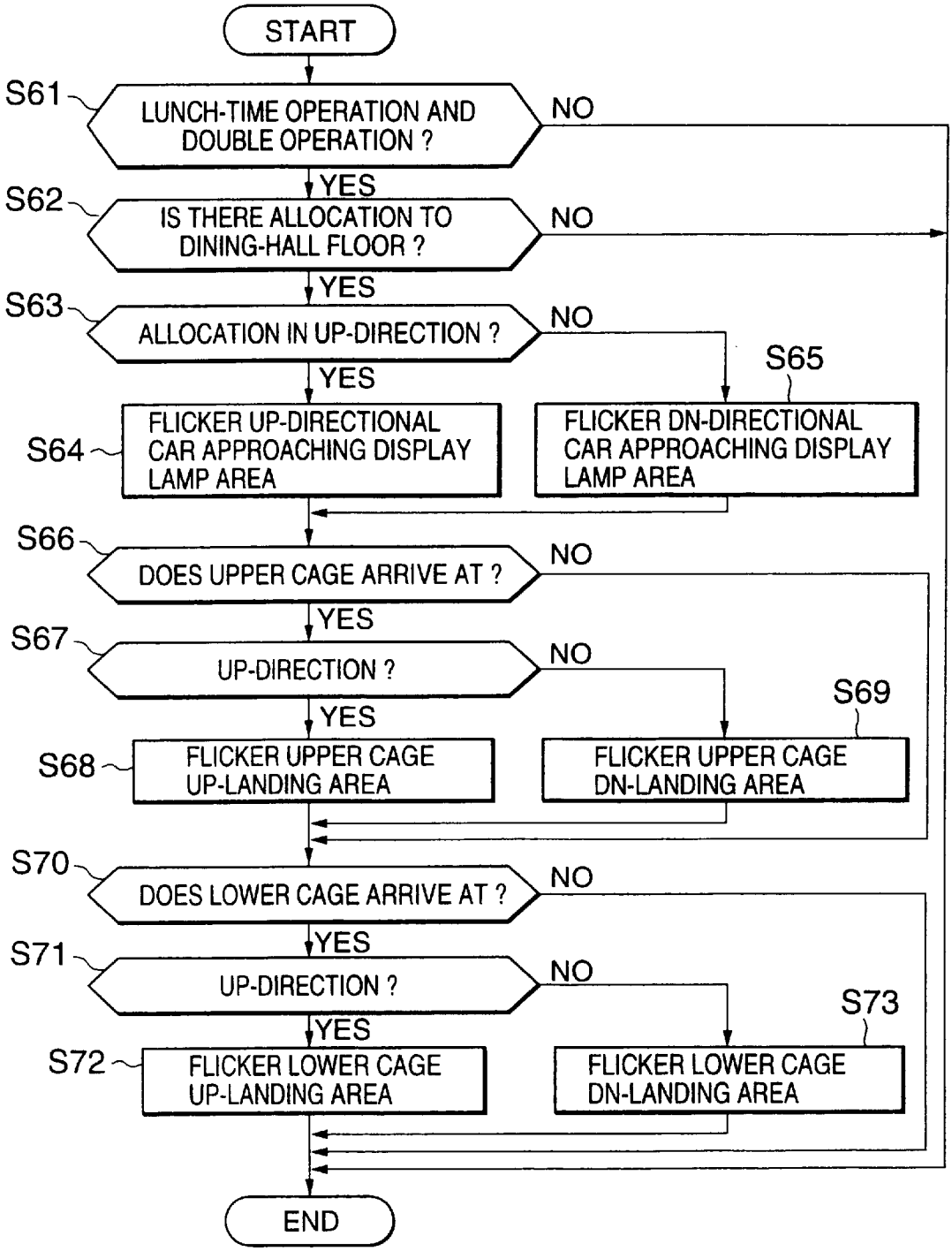
FIG. 6 is a flowchart showing an operation of a car approaching a display lamp control unit in the controlling apparatus shown in FIG. 1.

Referring to FIG. 6, it is judged in step S61 whether or not operation is in the lunch-time operation and in the double operation, and further it is judged in step S62 whether or not there is allocating to the dining hall floor. If affirmative both in step S61 and in step S62, it is judged in step S63 whether or not the allocation is the UP-directional allocation. If UP-directional, the UP-direction car approaching display lamp areas 6U of the car approaching display lamps 6*a*–6*h* are lit up (step S64). Whereas if not UP-directional, the DN-direction car approaching display lamp areas 6D are lit up (step S65). Next, it is judged in step S66 whether or not the upper cage arrives, and, if the upper cage arrives, it is judged in step S67 whether in the UP-direction or not. If in the UP-direction, the upper cage UP-landing flicker areas 6UUF of the car approaching display lamps 6*a*–6*h* are flickered (step S68). Whereas if not in the UP-direction, the upper cage DN-landing flicker areas 6DUF are flickered (step S69). Then, it is judged in step S70 whether or not the lower cage arrives, and, if the lower cage arrives, it is judged in step S71 whether in the UP-direction or not. If in the UP-direction, the lower cage UP-landing flicker areas 6UDF are flickered (step S72). Whereas if not in the UP-direction, the lower cage DN-landing flicker areas 6DDF are flickered (step S73).

With this process, the car approaching display lamp areas 6U, 6D are lit up when in the dining hall floor call registering process, the passengers are able to recognize which elevator the call registration is allocated to. Then, when landed, it is determined whether the upper or lower halves of the car approaching display lamp areas 6U, 6D should be flickered depending on whether the upper or lower cage arrives.

Figure 7:
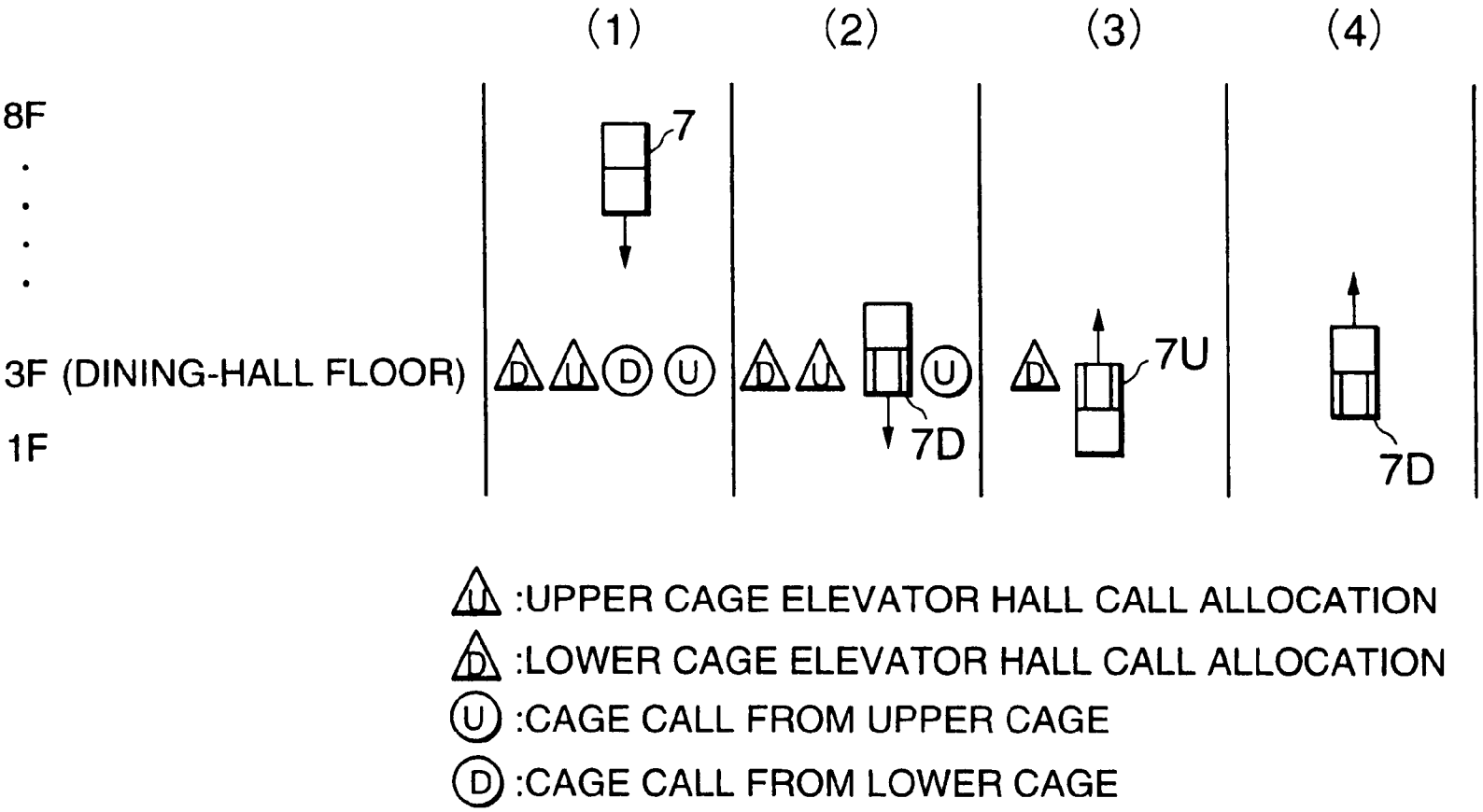
FIG. 7 is an explanatory diagram showing an operation of the elevator in connection with an operation control unit in the controlling apparatus shown in FIG. 1.

FIG. 7 is an explanatory diagram showing an operation of the elevator in connection with the operation control units 8A, 8B in the first embodiment. Supposing that there are given the elevator hall call to the dining hall floor (the specified floor) and the cage calls from the upper and lower cages, (1) the elevator (the cage 7) responds from the upward direction, in which case (2) the elevator responds at first to the cage call from the lower cage 7D, (3) then the elevator simultaneously responds to the cage call from the upper cage 7U and to the hall call allocation of the upper cage 7U, and (4) finally the elevator responds to the hall call of the lower cage 7D. Namely, in this case, the elevator responds three times to the hall call to the dining hall floor (the specified floor) and the cage calls from the upper and lower cages.

As discussed above, in the first embodiment, the cage calls from the upper and lower cages to only the specified floor are effective. Then, both of the upper and lower cages are made to respond to the hall calls to the specified floor in the sequence that the upper cage responds first and the lower cage responds next, the passengers going toward the even-numbered floors get on the upper cages, and the passengers going toward the odd-numbered floors get on the lower cages. Then, thereafter, the responses are made with the even-numbered floors and the odd-numbered floors separated as in the case of the double operation. Accordingly, even when the demands concentrate on only the specified floor, it is feasible to operate the elevators exhibiting both of a high operation efficiency and a high serviceability for the passengers.

Figure 8:
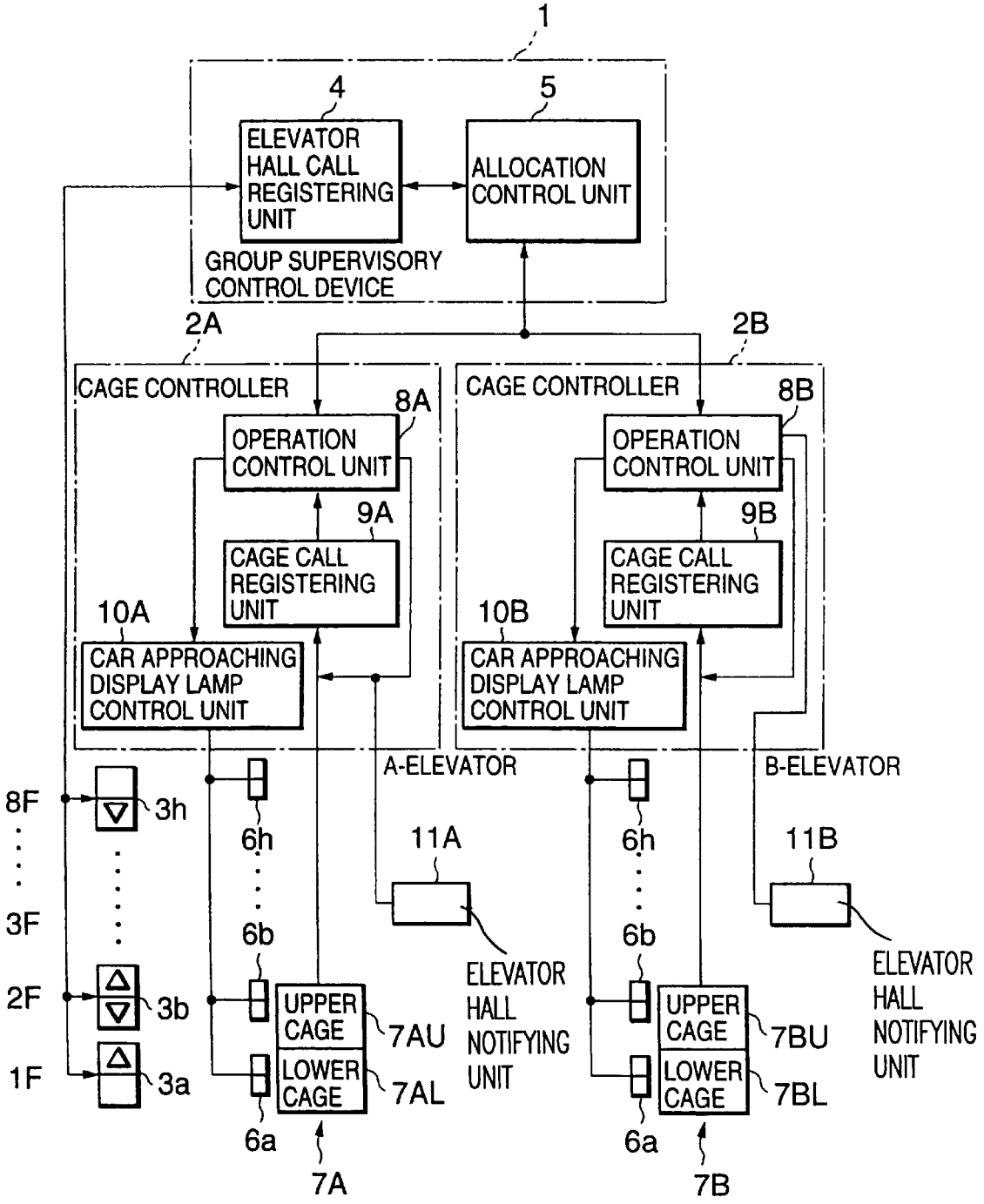
FIG. 8 is a diagram showing a construction of the controlling apparatus for the double deck elevator in a second embodiment of the present invention.

Next, a second embodiment of the present invention will be described. FIG. 8 is a block diagram showing the double deck elevator controlling apparatus in the second embodiment of the present invention. In the second embodiment, as compared with the first embodiment shown in FIG. 1, when the upper or lower cage arrives earlier at the specified floor in response to the hall call and the cage call, this cage temporarily runs in the opposite direction in order to make other passengers get off while the passengers on the specified floors are kept waiting, however, there are additionally provided elevator hall notifying units 11A, 11B for announcing for prompting the passengers to get on the cage ahead. The elevator hall notifying units 11A, 11B are controlled by the operation control units 8A, 8B of the controllers 2A, 2B.

The elevator hall notifying unit 11 announces in a case where there exist both of the hall call to the specified floor which is allocated by the allocation control unit 5 and the cage call to the specified floor which is registered in the cage call registering unit 9, and the elevator reverses its direction at the specified floor and responds to the hall call.

Figure 9:
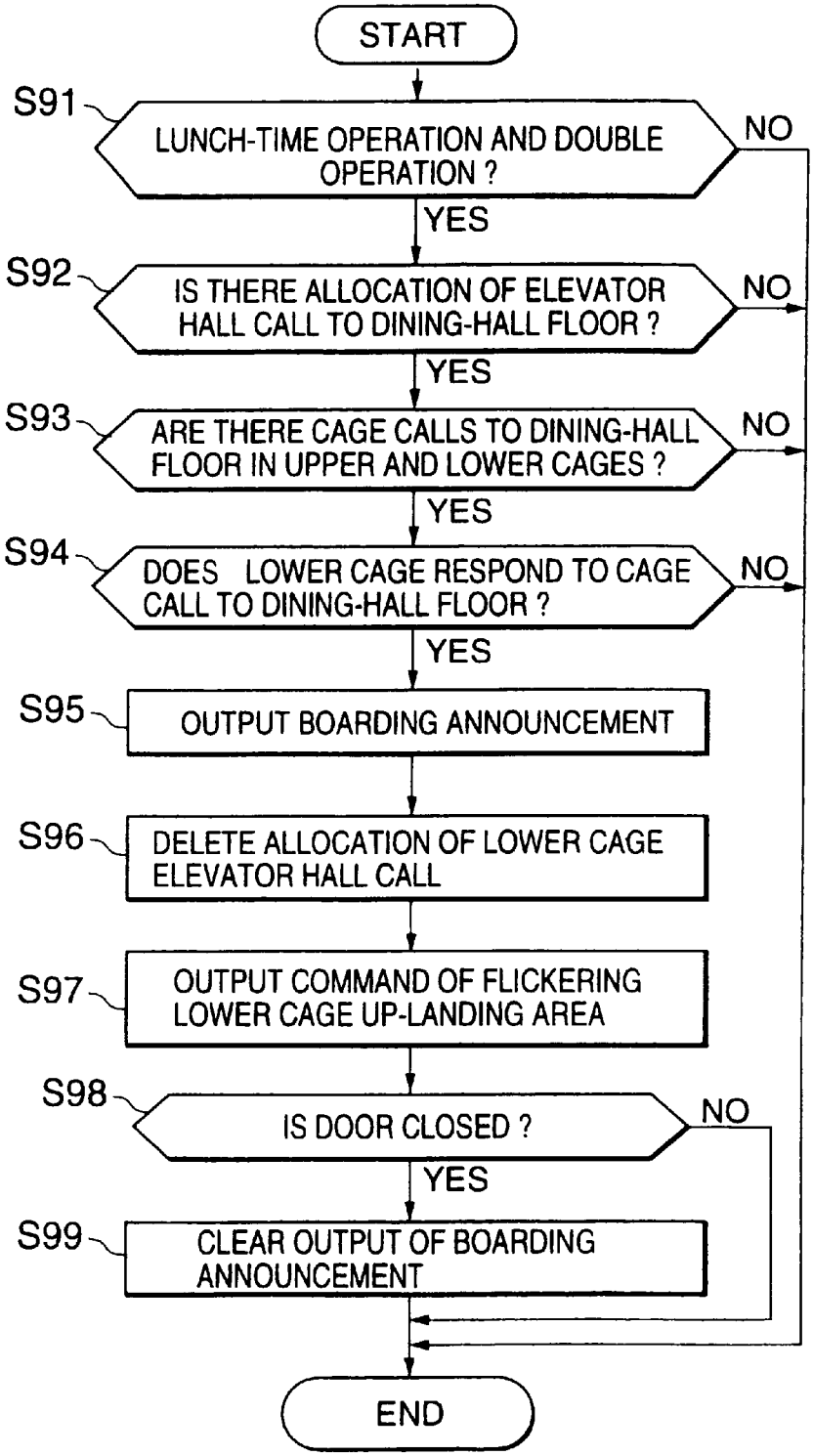
FIG. 9 is a flowchart showing the operation of the operation control unit in the second embodiment of the present invention.

FIG. 9 is a flowchart showing operations of the operation control units 8A, 8B in the second embodiment. Referring to FIG. 9, it is judged in step S91 whether or not operation is in the lunch-time operation and in the double operation, and it is judged in step S92 whether or not the hall call to the dining hall floor is allocated. If affirmative both in step S91 and in step S92, it is judged in step S93 whether or not the cage call to the dining hall floor is given to the upper and lower cages. Then, if the cage call is given to the upper and lower cages, it is judged in step S94 whether or not the lower cage responds to the cage call to the dining hall floor.

If judged to be affirmative both in step S93 and in step S94, the operation control units 8A, 8B issue to the hall notifying units 11A, 11B a command purporting that the boarding announcement should be made in order to let the passengers on the specified floor get on the lower cage. A content of this boarding announcement is, for example, that "This cage goes temporarily to the second floor for boarding the upper cage but goes back in the upper direction. Please, get on this cage if you wish to go to the odd-numbered floors.", and so on. Then, the lower cage hall call allocation is deleted in step S96, thereby preventing the lower cage from again responding to the upper cage response. In step S97, the lower cage UP-landing flicker area 6UDF of the UP-direction car approaching display lamp area 6U is lit up through the car approaching display lamp control units 10A, 10B. Next, it is judged in step S98 whether the door is closed or not. If closed, the boarding announcement command is cleared in step S99.

Figure 10:
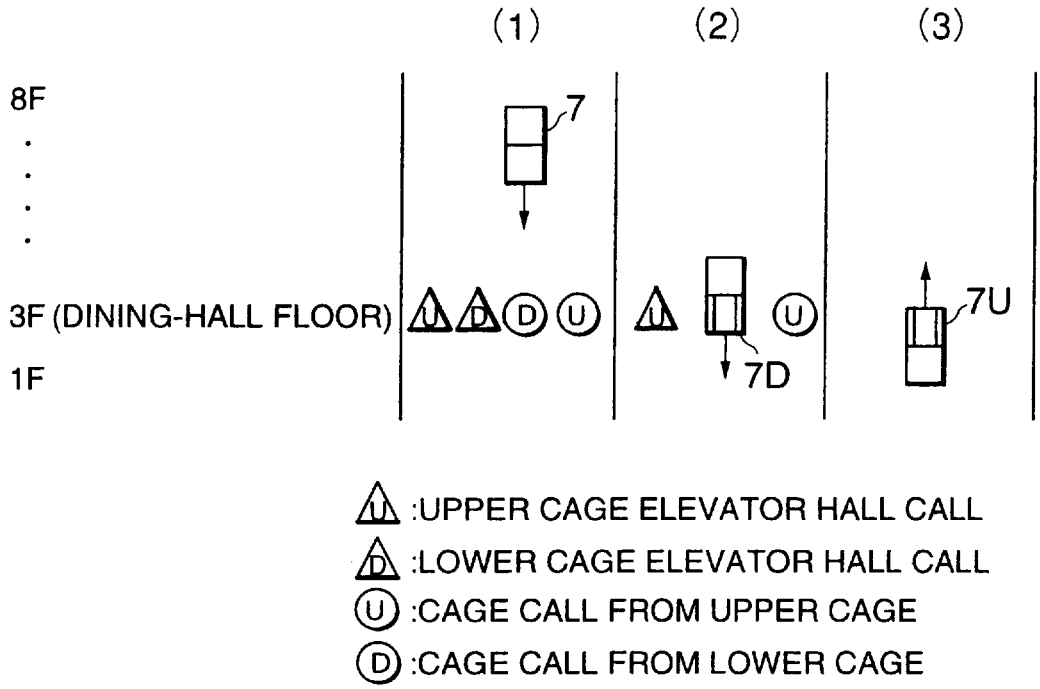
FIG. 10 is an explanatory diagram showing the operation of the elevator in connection with the operation control unit in the controlling apparatus shown in FIG. 9.

Next, an operation of the elevator in connection with the operation control units 8A, 8B in the second embodiment will be explained with reference to FIG. 10. Supposing that there are, as shown in FIG. 10, both the elevator hall call to the dining hall floor and the cage calls of the upper and lower cages, (1) the elevator cage 7 responds from the upper direction, in which case (2) the elevator simultaneously responds the cage call from the lower cage 7D and to the hall call allocation of the lower cage, and then (3) the elevator simultaneously responds to the cage call from the upper cage and to the hall call allocation of the upper cage. Accordingly, in this case, it turns out that the elevator responds twice to the elevator hall call to the dining hall floor (the specified floor) and to the cage calls from the upper and lower cages, and the response thereof is thus completed.

In accordance with the second embodiment, if there are given both of the hall call to the specified floor and the cage calls from the upper and lower cages at the specified floor, the boarding announcement to prompt the passengers on the specified floor to get on the elevator ahead when the cage call of the head cage arrives. This makes the passengers easily identify the cage, and it is feasible to simultaneously make the responses to the hall call and to the cage call.

Figure 11:
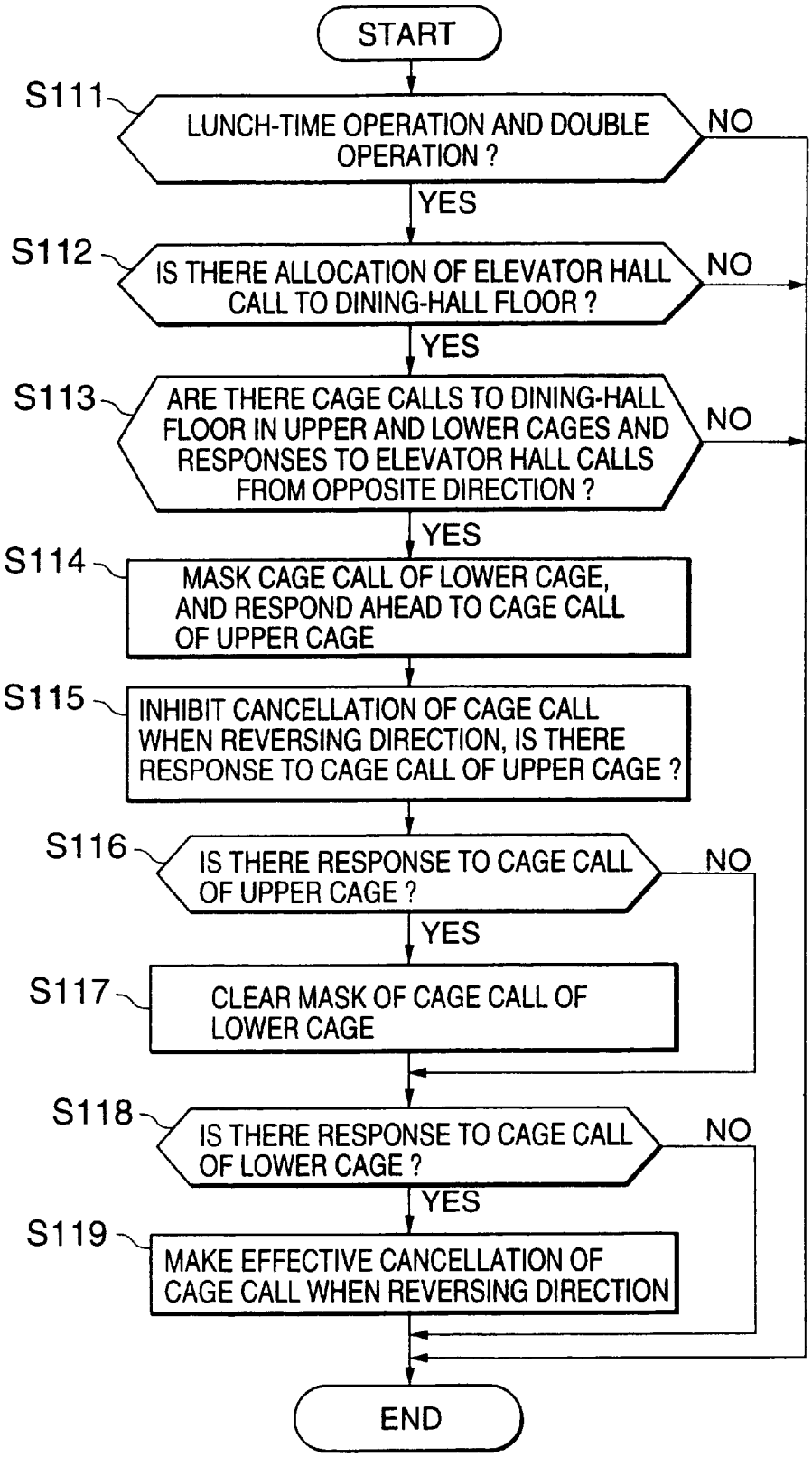
FIG. 11 is a flowchart showing the operation of the operation control unit in a third embodiment of the present invention.

Next, a third embodiment of the present invention will be discussed. FIG. 11 is a flowchart showing operations of the operation control units 8A, 8B in the third embodiment of the present invention. A characteristic of the third embodiment is, as compared with the first and second embodiments, that there are given both of the hall call to the specified floor which is allocated by the allocation control unit 5 and the cage call to the specified floor which is registered in the cage call registering units 9A, 91B, in which case the operation control units 8A, 8B operate so that the elevator responds ahead to the cage call of the upper cage if the call is an UP-directional hall call, and responds ahead to the cage call of the lower cage if it is a DN-directional hall call.

Referring to FIG. 11, it is judged in step S111 whether or not operation is in the lunch-time operation and in the double operation, and, if judged to be affirmative, it is judged in step S112 whether or not there is an elevator hall call allocation of the dining hall floor. Then, if affirmative in step S112, it if judged in step S113 whether or not there are cage calls of the upper and lower cages to the dining hall floor and a response to the hall call from the opposite direction. If affirmative in step S113, the cage call of the lower cage is masked, and the elevator responds ahead to the cage call of the upper cage in step S114. Further, the direction is reversed while the cage call of the lower cage remains unresponsive, and hence a cancellation of the cage call is inhibited when reversing the direction in step S115.

Next, it is judged in step S116 whether or not the cage call for the upper cage is responded to, and, if responded to, the lower cage call mask executed previously in step S114 is cleared, whereby the cage call of the lower cage can be responded to. Next, it is judged in step S118 whether or not the cage call of the lower cage is responded to, and, if responded to, the cancellation of the cage call at the direction reversing time, which has been executed in step S115, is made effective (step S119).

Figure 12:
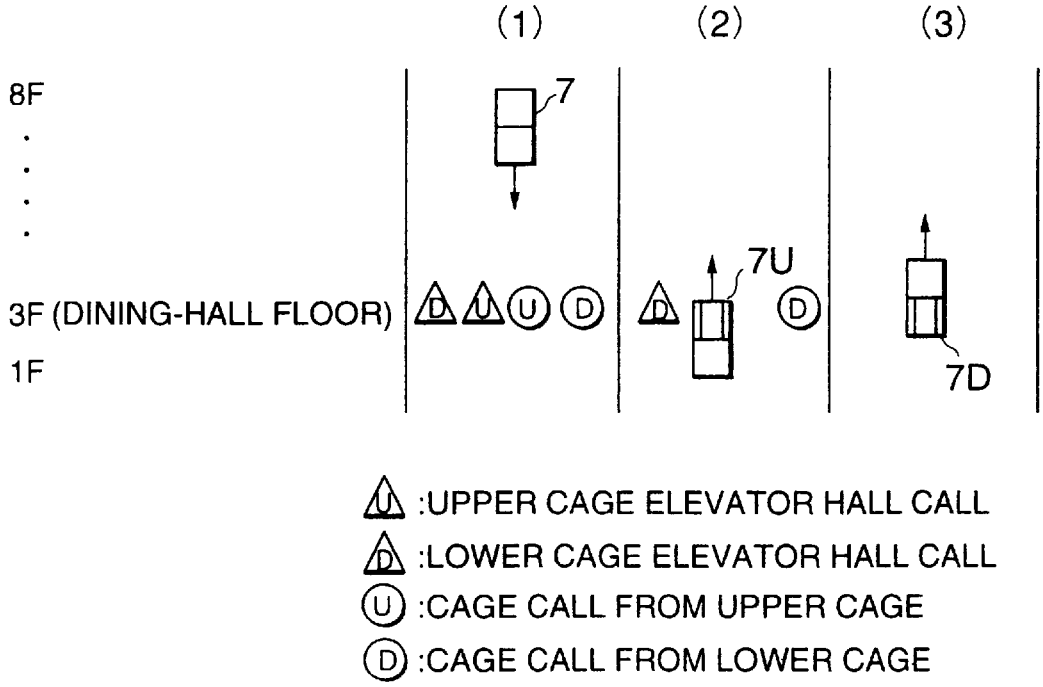
FIG. 12 is an explanatory diagram showing the operation of the elevator in connection with the operation control unit in the third embodiment of the present invention.

FIG. 12 is an explanatory diagram showing an operation of the elevator in connection with the operation control units 8A, 8B in the third embodiment. As shown in FIG. 12, (1) the elevator cage 7 responds from the UP-direction to the elevator hall call to the dining hall floor and to the cage calls of the upper and lower cages, in which case (2) there are simultaneously made responses to the cage call of the upper cage 7U and to the hall call allocation of the upper cage, and (3) there are simultaneously made responses to the cage call of the lower cage 7D and to the hall call allocation of the lower cage.

In the third embodiment, when there are given both of the hall call to the specified floor and the cage calls of the upper and lower cages to the specified floor, the cage call of the upper cage is responded ahead to first in the case of the UP-directional hall call, and the cage call of the lower cage is responded ahead to first in the case of DN-directional hall call. This makes it feasible to simultaneously respond to the hall call and to the cage call, whereby the number of stops of the elevator can be reduced.

Figure 13:
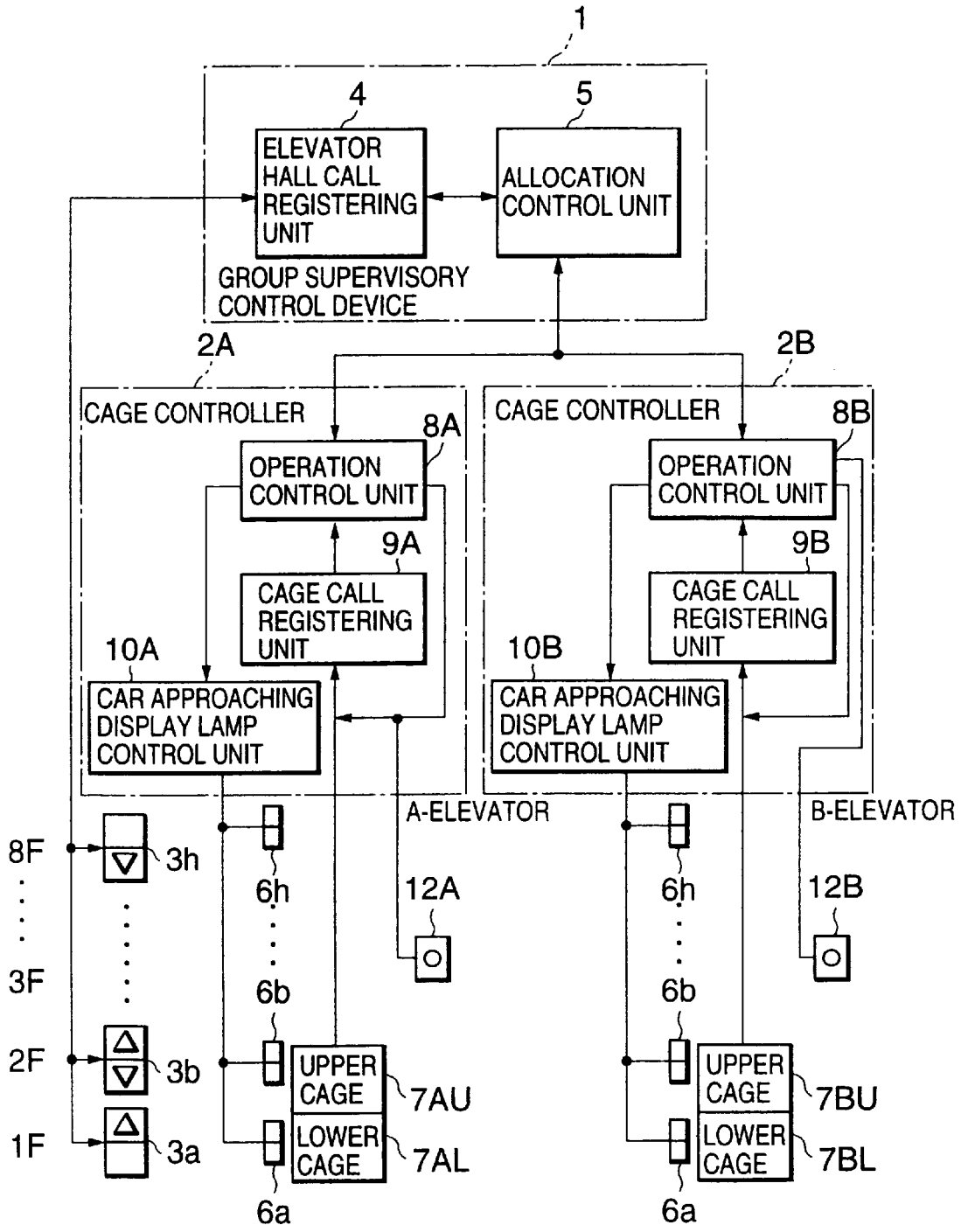
FIG. 13 is a block diagram of the controlling apparatus for the double deck elevator in a fourth embodiment of the present invention.

FIG. 13 shows a controlling apparatus for the double deck elevator in a fourth embodiment of the present invention. In the fourth embodiment, by contrast with the first embodiment shown in FIG. 1, elevator hall door closing buttons 12A, 12B for closing the door of the elevator and prompting it to start off at the elevator hall on the specified floor are provided. Door closing signals transmitted from the elevator hall door closing buttons 12A, 12B are inputted to the operation control units 8A, 8B. Operations of the elevator hall door closing buttons 12A, 12B have the same functions as that of the door closing button in the cage. A difference from the function of the intra-cage door closing button is that the elevator hall door closing buttons 12A, 12B are effective only when the door of the elevator opens at the specified floor.

When registering the UP-directional hall call to the dining hall floor defined as the specified floor, the elevator halts at the dining hall floor in such a sequence that the upper cage 7AU (or 7BU) stops first and the lower cage 7AL (or 7BL) stops next. Accordingly, it is useless to stop the upper cages 7AU, 7BU in the case of only the passengers going to, e.g., the odd-numbered floors. This being the case, when the upper cages 7AU, 7BU arrive, the doors of the upper cages 7AU, 7BU are closed by pressing the elevator hall door closing buttons 12A, 12B, thus prompting the elevator to start off. This contrivance makes it possible to relieve the passengers from feeling irritated due to the useless stop.

As described above, in the fourth embodiment, when the cage, which does not cover a floor desired by the passengers, arrives ahead at the specified floor, this cage is prompted to start off with its door closed by pressing the elevator hall door closing buttons 12A, 12B.

In the discussion made so far, what is provided with the elevator hall door closing buttons 12A, 12B has been shown in comparison with the first embodiment. The elevator hall door closing buttons 12A, 12B may also be, however, provided in the second and third embodiments.

Figure 14:
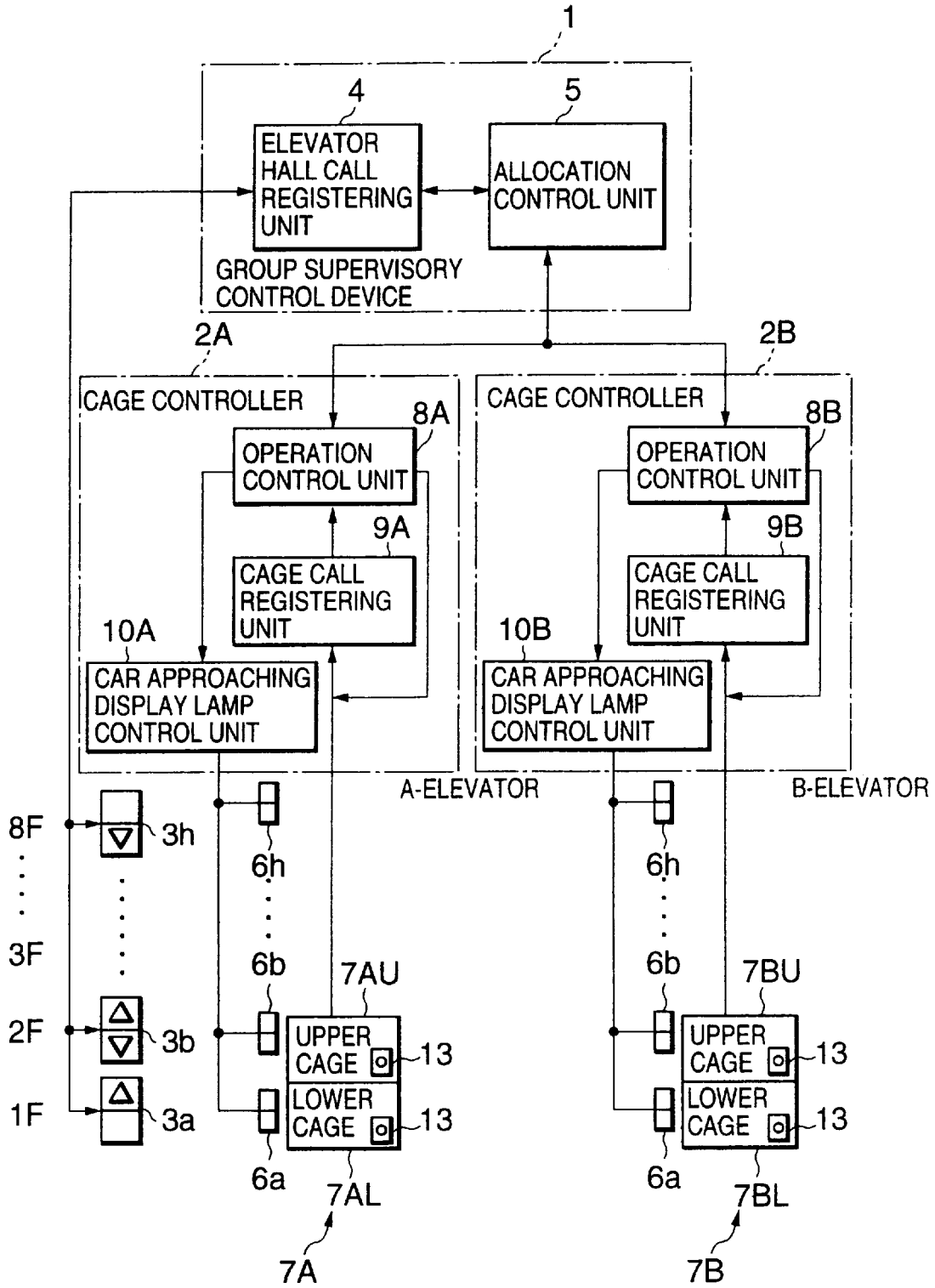
FIG. 14 is a block diagram of the controlling apparatus for the double deck elevator in a fifth embodiment of the present invention.

FIG. 14 shows a controlling apparatus for the double deck elevator in a fifth embodiment of the present invention. The fifth embodiment has, as compared with the first embodiment, such a construction that alternative cage door closing buttons 13, provided respectively in the upper and lower cages, for prompting, when the alternative cage halts at the elevator hall and opens its door, the elevator to start off by closing the alternative cage.

Referring to FIG. 14, a different point from the first embodiment shown in FIG. 1 is that the alternative cage door closing buttons 13 are added to within the upper cages 7AU, 7BU and the lower cages 7AL, 7BL. An alternative cage door closing signal is inputted to the operation control units 8A, 8B by pressing the alternative cage door closing buttons 13. The alternative cage door closing signals, when pressing the alternative cage door closing buttons 13 in, e.g., the upper cages 7AU, 7BU, function to close the doors of the lower cages 7AL, 7BL of the same elevator. In the case of the UP-directional operation, after the passengers on the specified floor have got on the upper cages 7AU, 7BU, no other passengers exist on the specified floor, and nevertheless it might happen that the alternative cages, i.e., the lower cages 7AL, 7BL reopen their doors at the specified floor. In such a case, the door of the lower cage is closed with the upper cage, thus prompting a quick start.

When registering the UP-directional hall call of the dining hall floor defined as the specified floor, the elevator halts in such a sequence that the upper cage stops first and the lower cage stops next. Therefore, in the case of only the passengers going toward the even-numbered floors, the halt of the lower cage becomes useless. In such a case, the door of the lower cage is closed by pressing the alternative cage door closing buttons 13 provided within the upper cage, thereby helping the passenger obviate the irritated feelings due to the useless stop.

As discussed above, the fifth embodiment enhances the serviceability in the case where the alternative cage stops at the elevator hall on the specified floor, but there is no passenger who gets thereon.

In the discussion given above, as compared with the first embodiment, what is provided with the alternative cage door closing buttons 13 has been exemplified. As a matter of course, however, the alternative cage door closing buttons 13 may be provided in the second, third and fourth embodiments.

Figure 15A:
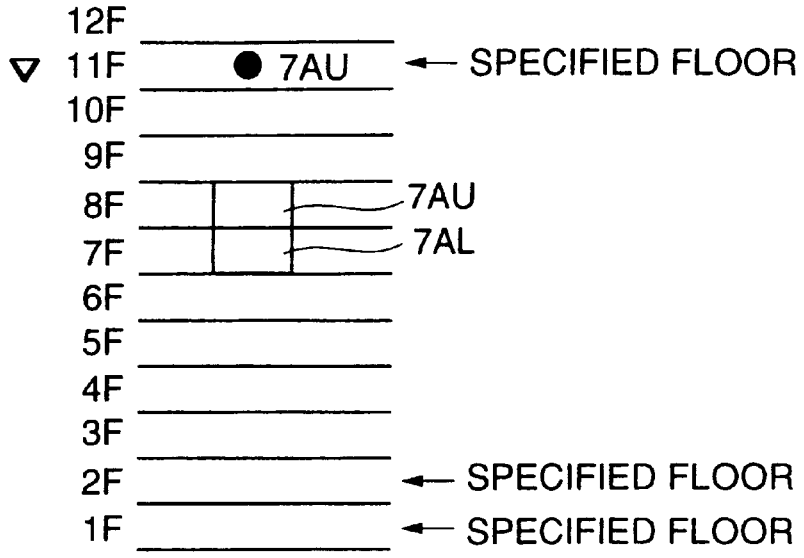
FIGS. 15A and 15B are explanatory diagrams showing the operation control in a sixth embodiment of the present invention.
Figure 15B:
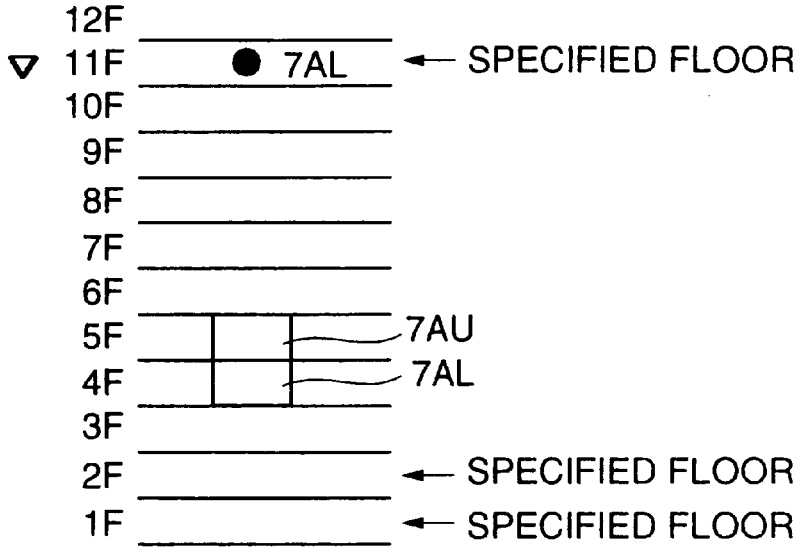

FIGS. 15A and 15B are explanatory diagrams each showing the operation control in a sixth embodiment of the present invention. Note that the embodiments which follow will deal with a 12-storied building extending from 1F up to 12F. Now, it is assumed that a single unit of A-elevator 7A be set as a reciprocating elevator which reciprocates between the specified floors, wherein first specified floors may be set to two consecutive floors, i.e., 1F and 2F, and a second other specified floor may be set to only one floor, i.e., 11F. Then, it is also assumed that the reciprocating elevator 7A be, as shown in FIG. 15A, now located between the seventh floor and the eighth floor. A further assumption is that a cage call (11.C) to the other specified floor (11F) is registered in the upper cage 7AU of the double deck elevator 7A classified as the reciprocating elevator. Herein, "11" of 11.C represents the eleventh floor, and "C" designates a cage call. A cage controller 2A transmits to the allocation control unit 5 cage call information (e.g., 11.C of the upper cage of the reciprocating elevator) possessed by each of the cages 7AU, 7AL as cage information. In this state, it is presumed that a DN-directional elevator hall call is newly registered with respect to the specified floor (11.C).

As shown in FIG. 15A, supposing that the hall call to the other specified floor (11F) is registered in the hall call registering unit 4, the allocation control unit 5 detects the upper cage 7AU or the lower cage 7AL of the predetermined reciprocating elevator 7A of which the lifting and lowering are reversed at the other specified floor (11F) on the basis of the cage information transmitted from the cage controllers 2A, 2B equipped in each elevator. Namely, the reciprocating elevator 7A reciprocates between the first specified floors (the first and second floors) and the other specified floor (11F), and the allocation control unit 5 therefore judges whether or not the cage call of the upper cage 7AU or the lower cage 7AL of the reciprocating elevator 7A to the other specified floor (11F), is registered. When judging that the cage call for going to the other specified floor (11F), the elevator hall call to the specified floor (11F) is allocated to the reciprocating elevator 7A. The simultaneous responses of the cages can be thereby increased in quantity. While on the other hand, when there is not registered the cage calls of both of the upper cage 7AU and the lower cage 7AL to the other specified floor (11F), the elevator hall call to the specified floor (11F) is allocated to the cage exhibiting a high evaluation value, and a command with respect to the allocation cage is sent to the cage controller 8A.

In the discussion made so far, there has been explained the case in which the cage call (11.C) to the other specified floor (11F) is registered in the upper cage 7AU. The allocation control is, however, as shown in FIG. 15, similarly implemented in a case in which the cage call (11.C) to the other specified floor (11F) is registered in the lower cage 7AL. Namely, FIG. 15B shows the case in which the lower cage 7AL located at the fourth floor is allocated with and responds to an eleventh-floor downward (DN) elevator hall call.

Figure 16:
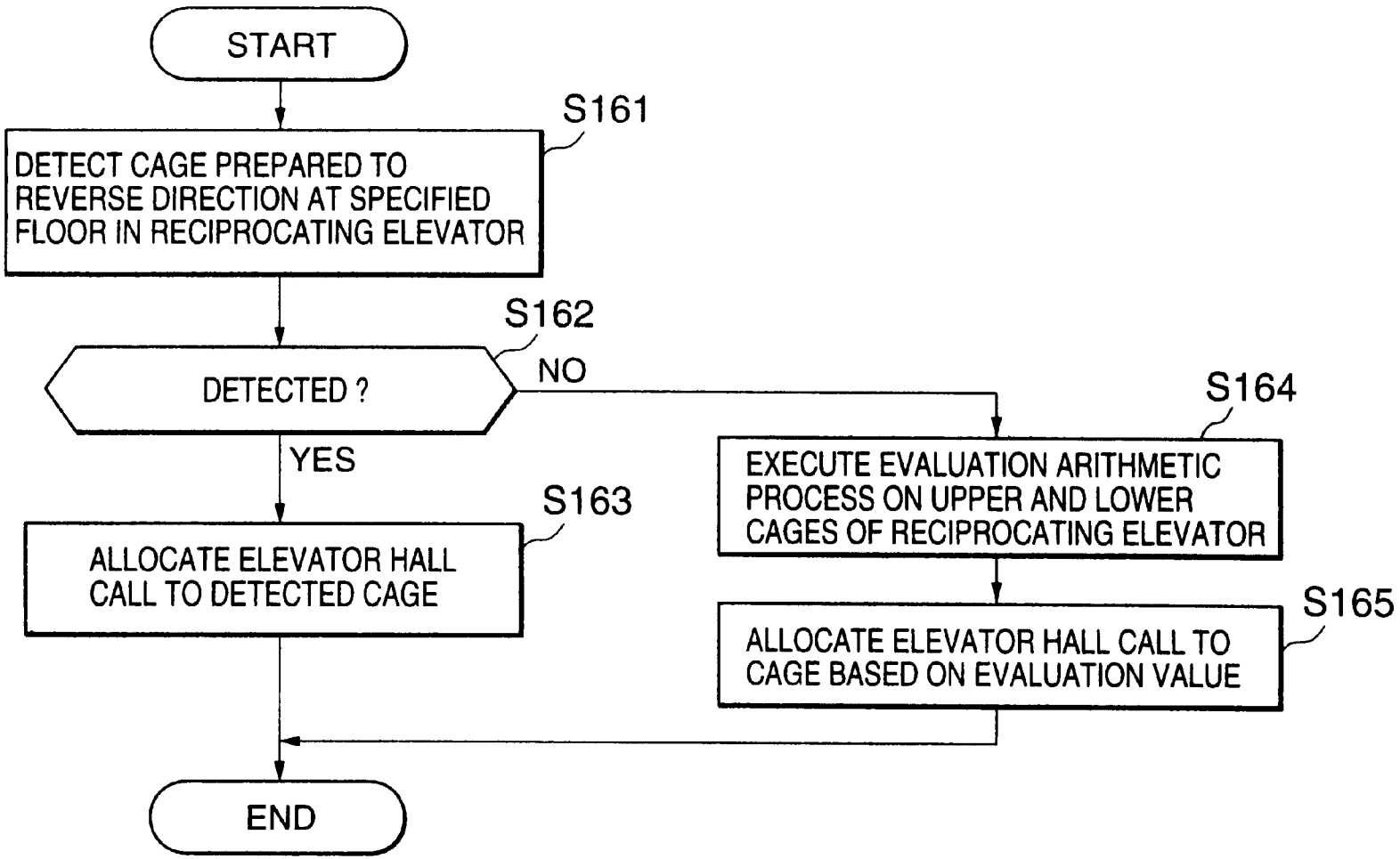
FIG. 16 is a flowchart shooting an operation of the allocation control unit in the sixth embodiment of the present invention.

FIG. 16 is a flowchart showing the operation of the allocation control unit 5. Supposing that the downward (DN) elevator hall call to the specified floor (11F) has been newly registered, the allocation control unit 5 detects based on the above elevator information whether or not there is the upper cage 7AU or the lower cage 7AL of the reciprocating elevator 7A of which the lifting and lowering are prepared to be reversed at the specified floor (step S161), and confirms a result thereof (step S162). Then, if it is detected that there is the upper cage or the lower cage of the reciprocating elevator 7A of which the lifting and lowering are prepared to be reversed at the specified floor, the elevator hall call to the specified floor is allocated to the upper or lower cage thereof (step S163). Note that if neither the upper cage nor the lower cage is detected, a predetermined evaluation arithmetic process is executed with respect to the upper and lower cages 7AU, 7AL of the reciprocating elevator 7A (step S164). Based on this evaluation value, the hall call is allocated to one of the upper and lower cages (step S165). A use of the prediction arrival time up to the newly registered elevator hall call may be exemplified by way of an index of the predetermined evaluation arithmetic process in that case. That is, what has the shorter prediction arrival time may be given a good evaluation.

In accordance with the sixth embodiment, the simultaneous response is attained by allocating the call to the cage of which the lifting and lowering are prepared to be reversed at the specified floor with the registration of the elevator hall call, thereby preventing the useless halt. Accordingly, the serviceability for the users is enhanced.

Figure 17A:
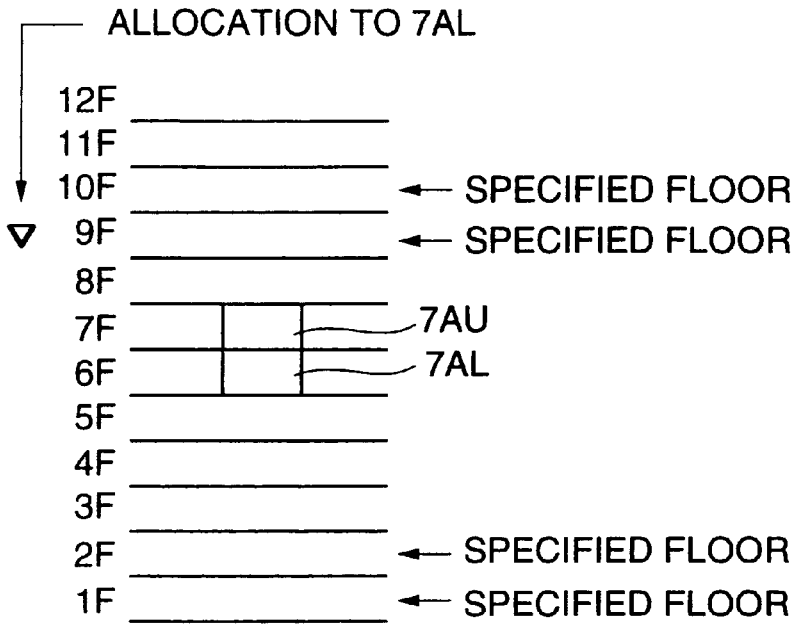
FIGS. 17A and 17B are explanatory diagrams showing the operation control in a seventh embodiment of the present invention.
Figure 17B:
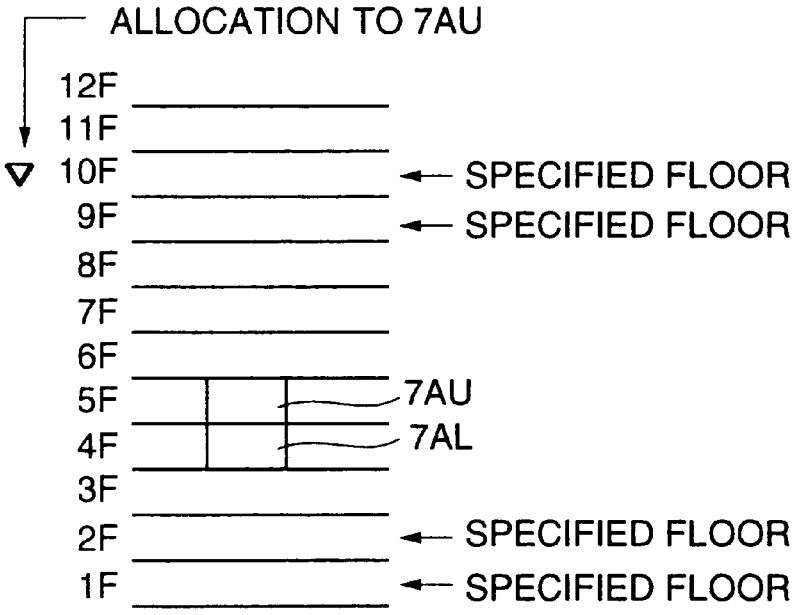

Next, a seventh embodiment of the present invention will be explained. In the seventh embodiment, both of the specified floors between which the reciprocating elevator reciprocates are each constructed of twvo consecutive floors, wherein if the elevator hall call to the specified floor is a call to the upper floor of the two consecutive specified floors, this elevator hall call is allocated to the upper cage, and if the call is a call to the lower floor of the specified floors, the elevator hall call is allocated to the lower cage. FIG. 17A shows a case in which the elevator hall call to the specified floors is the call to the lower floor. FIG. 17B shows a case in which the elevator hall call to the specified floors is the call to the upper floor.

Referring to FIG. 17A, it is now assumed that a single unit of A-elevator be set as a reciprocating elevator which reciprocates between the specified floors, of which first specified floors are constructed of two consecutive floors, and second other specified floors are also constructed of two consecutive floors of 9F and 10F. Then, the A-elevator reciprocating therebetween is first, it is assumed, located at 6F and 7F as shown in FIG. 17A. Incidentally, it is presumed that the cage call to the specified floors (9F and 10F) is not registered in the upper and lower cages 7AU, 7AL of the double deck elevator 7A classified as the reciprocating elevator.

In this state, supposing that the downward (DN) elevator hall call to the specified floor 9F is newly registered, the allocation control unit 5, because of the call being allocated to the lower floor (9F) of the two consecutive specified floors 9F, 10F, allocates to the lower cage 7AL the elevator hall call to the specified floor (9F). On the other hand, as shown in FIG. 17B, supposing that the downward (DN) elevator hall call to the specified floor (10F) is newly registered, the allocation control unit 5, because of the call being allocated to the upper floor (10F), allocates the elevator hall call to the specified floor (10F) to the upper cage 7AU located at 5F.

In accordance with the seventh embodiment, when both of the specified floors are each constructed of the two consecutive floors, the elevator hall call to the upper specified floor is allocated invariably to the upper cage, and the elevator hall call to the lower specified floor is allocated to the lower cage. With this allocation, the simultaneous responses of the upper and lower cages increase in quantity, whereby the useless stop can be obviated and the operation efficiency can be enhanced.

Figure 18A:
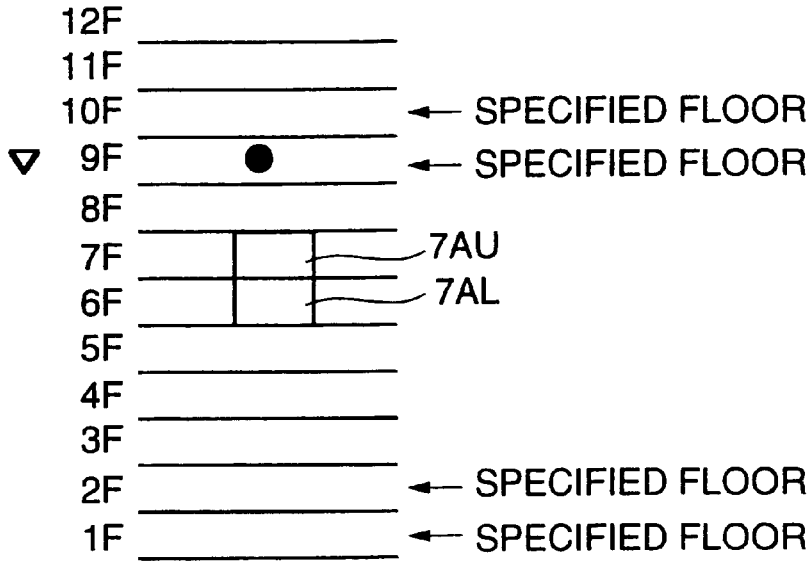
FIGS. 18A and 18B are explanatory diagrams showing the operation control in an eighth embodiment of the present invention.
Figure 18B:
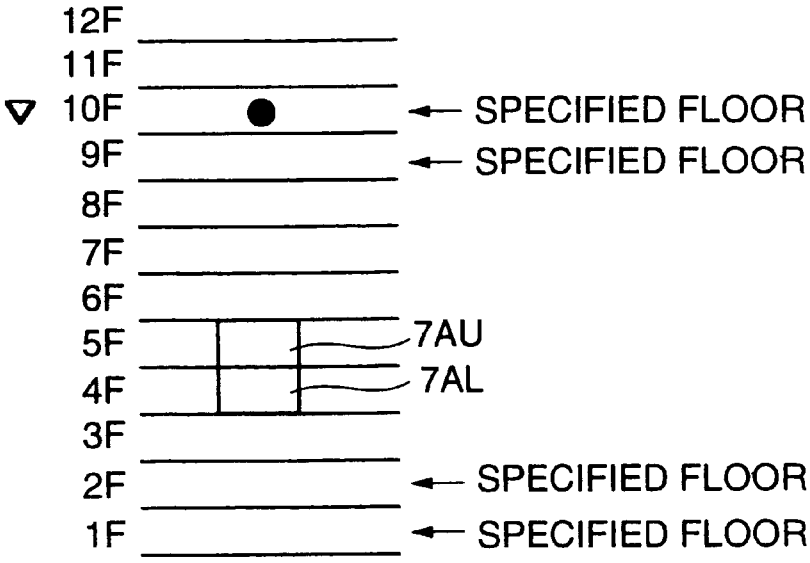

FIGS. 18A and 18B are explanatory diagrams each showing the operation control in an eighth embodiment of the present invention. In the eighth embodiment, both of the specified floors between which the reciprocating elevator reciprocates are each constructed of two consecutive floors, and the elevator hall call to the specified floor is allocated to the upper or lower cage of the reciprocating elevator of which the lifting and lowering are prepared to be reversed at the specified floor. FIG. 18A shows a case in which the elevator hall call to the specified floor (9F) is allocated to the lower cage 7AL having the cage call to the specified floor (9F). FIG. 18B shows a case in which the elevator hall call to the specified floor (10F) is allocated to the upper cage 7AU having the cage call to the specified floor (10F).

Referring to FIG. 18A, it is now assumed that a single unit of A-elevator be set as a reciprocating elevator which reciprocates between the specified floors, of which first specified floors are constructed of two consecutive floors 1F, 2F, and second other specified floors are also constructed of two consecutive floors of 9F and 10F. Then, the reciprocating elevator is first, it is assumed, located at 6F and 7F as shown in FIG. 18A. It is further presumed that the upper cage 7AU be registered with a cage call (9.C) to the other specified floor (9F). In this state, it is assumed that the downward (DN) elevator hall call to the specified floor 9F be newly registered.

In this case, the elevator hall call is a call to the lower floor 9F of the two consecutive specified floors, and the upper cage 7AU is registered with the cage call to the specified floor 9F. Therefore, the allocation control unit 5 allocates the elevator hall call to the upper cage 7AU.

On the other hand, as shown in FIG. 18B, supposing that the downward (DN) elevator hall call to the specified floor 10F is newly registered, the allocation control unit 5, because of the elevator hall call being a call to the upper floor 11F of the two consecutive specified floors and of the cage call of the specified floor 11F being registered in the lower cage 7AL located at 4F, allocates the elevator hall call to the lower cage 7AL.

As discussed above, the allocation control unit 5 allocates the elevator hall call to the specified floor to the upper or lower cage of the reciprocating elevator of which the lifting and lowering are prepared to be reversed at the specified floor. Then, if the cage call is given to neither the upper cage nor the lower cage, the predetermined evaluation arithmetic process described above is executed with respect to the upper and lower cages, and the elevator hall call to the specified floor is allocated to the cage exhibiting a higher evaluation value thereof.

In accordance with the eighth embodiment, when the specified floors are constructed of the two consecutive floors, the call is allocated to the cage of which the lifting and lowering are prepared to be reversed at the specified floor with the registration of the elevator hall call, whereby the simultaneous responses are attained, and the useless halt can be obviated. Further, the allocation cage is not limited, and hence the users are able to go to any specified floors.

Figure 19A:
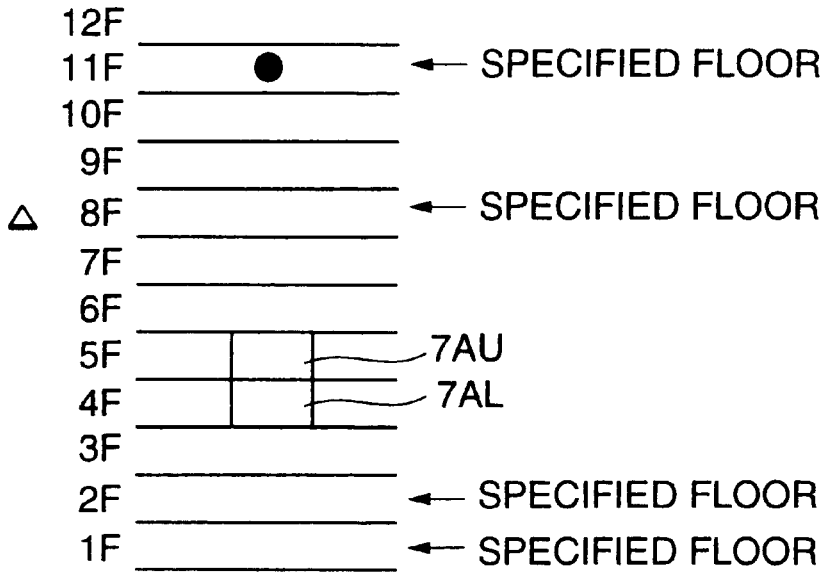
FIGS. 19A and 19B are explanatory diagrams showing the operation control in a ninth embodiment of the present invention.
Figure 19B:
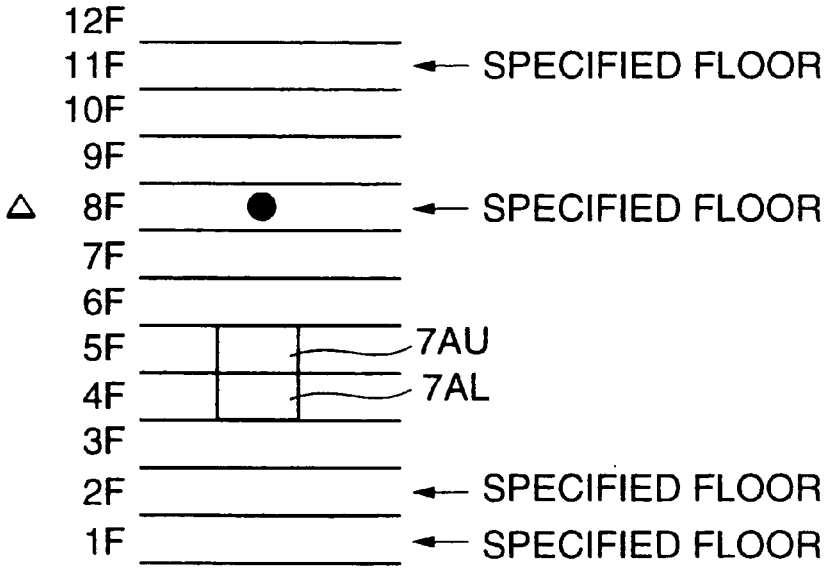

FIGS. 19A and 19B are explanatory diagrams each showing the operation control in a ninth embodiment of the present invention. In the ninth embodiment, the specified floors between which the reciprocating elevator reciprocates are constructed of first specified floors consisting of the two consecutive floors, and a second other specified floor consisting of only one floor, with only one intermediate specified floor existing therebetween. When the elevator hall call to the specified floor is registered in the elevator hall call registering unit 4, the allocation control unit 5 allocates the call to the upper or lower cage of the reciprocating elevator prepared to halt at the specified floor with the registration of the elevator hall call. Further, if there is neither the upper cage nor the lower cage prepared to halt at the specified floor with the registration of the elevator hall call, the call is allocated to the upper or lower cage prepared to stop at the specified floor farther than the specified floor with the registration of the elevator hall call.

FIG. 19A shows a case in which the elevator hall call to the intermediate specified floor (8F) is allocated to a lower cage 3A to which the cage call to the other specified floor (11F) is given. FIG. 19B shows a case in which the elevator hall call to the intermediate specified floor (8F) is allocated to Em upper cage 2A to which the cage call to the intermediate specified floor (8F) is given.

Referring to FIG. 19A, it is now assumed that the A-elevator 7A be set as a reciprocating elevator which reciprocates between the specified floors, of which first specified floors are constructed of two consecutive floors 1F, 2F, and a second other specified floor is constructed of the single floor 11F. Then, only one specific floor is set to an intermediate floor 8F. Then, the reciprocating elevator 7A is first, it is assumed, located at 4F and 5F as shown in FIG. 19A. It is further presumed that the lower cage 7AL of the reciprocating elevator 7A be registered with a cage call (11.C) to the other specified floor 11F. In this state, it is assumed that the upward (UP) elevator hall call to the intermediate specified floor 8F be newly registered.

The allocation control unit 5, because of the elevator hall call being a call to the intermediate floor 8F and of the cage call of the other specified floor 11F ahead thereof being registered in the lower cage 7AL, allocates the elevator hall call to the lower cage 7AL thereof. In this case, the cage controller 2A transmits to the allocation control unit 5 the call information (the lower cage of the reciprocating elevator: 11.C) possessed by the cage as cage information.

On the other hand, as shown in FIG. 19B, it is assumed that, for example, an upward (UP) elevator hall call to the intermediate specified floor 8F be newly registered, the allocation control unit 5, because of the elevator hall call being a call to the intermediate specified floor 8F, allocates the elevator hall call to the upper cage 7AU to which the cage call is given. In this case, the cage controller 2A transmits to the allocation control unit 5 the call information (the upper cage of the reciprocating elevator: 8.C) possessed by the cage as cage information.

Figure 20:
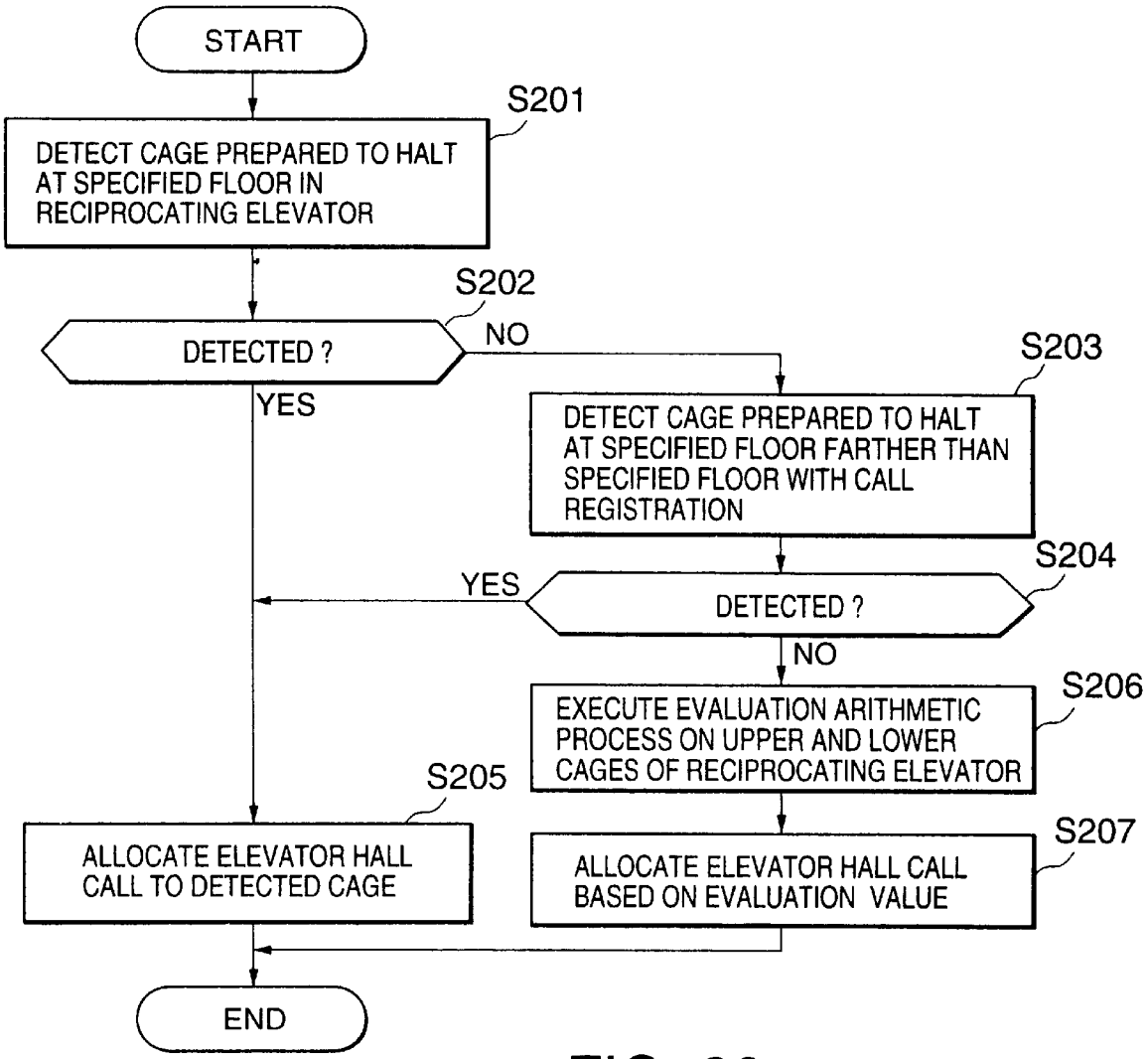
FIG. 20 is a flowchart showing the operation of the allocation control unit in the ninth embodiment of the present invention.

FIG. 20 is a flowchart showing the operation in a ninth embodiment. If the upward (UP) elevator hall call to the intermediate specified floor 8F is newly registered, the allocation control unit 5 judges whether or not there is a cage prepared to stop at 8F with the registration of the elevator hall call (steps S201, S202). In the case shown in FIG. 19A, the cage prepared to halt at 8F with registration of the elevator hall call is not detected, and therefore the allocation control unit 5 judges whether or not there is a cage prepared to stop at the specified floor 11F located farther than 8F (steps S203, S204). In the case shown in FIG. 19A, the lower cage 7AL is detected, and hence the call is allocated to the detected lower cage 7AL (step S205). If it is judged in step S204 that the cage is not detected, the predetermined evaluation arithmetic process is executed with respect to the upper and lower cages 7AU, 7AL of the reciprocating elevator (step S206). The allocation cage is determined based on the evaluation value thereof (step S207). If it is judged in step 202 that the upper cage 7AU, as shown in FIG. 19B, is detected, the upward elevator hall call to 8F is allocated to the upper cage 7AU.

In accordance with the ninth embodiment, the cage prepared to halt at the specified floor farther than the specified floor with the specified floor with the registration of the elevator hall call, is also set as an allocation object, whereby the simultaneous responses increase in quantity, and the useless halt can be obviated.

Figure 21A:
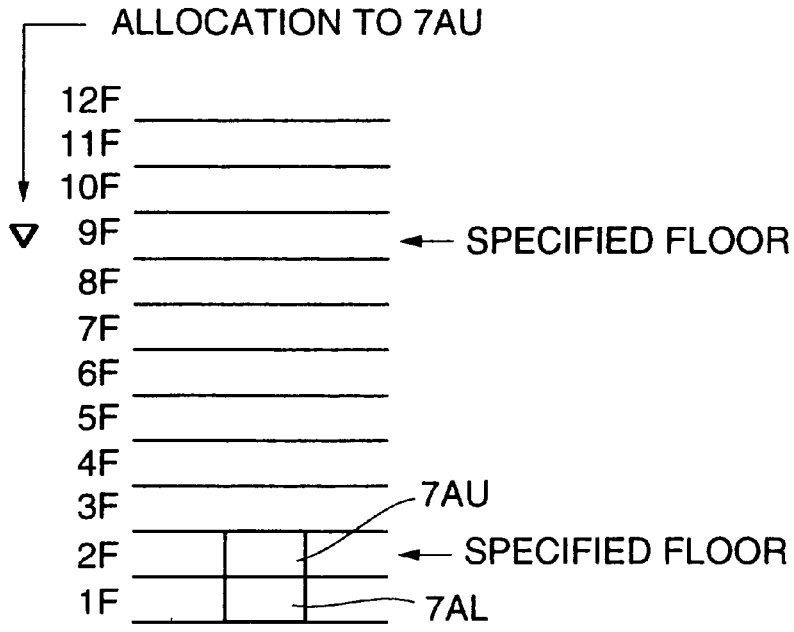
FIGS. 21A and 21B are explanatory diagrams showing the operation control in a tenth embodiment of the present invention.
Figure 21B:
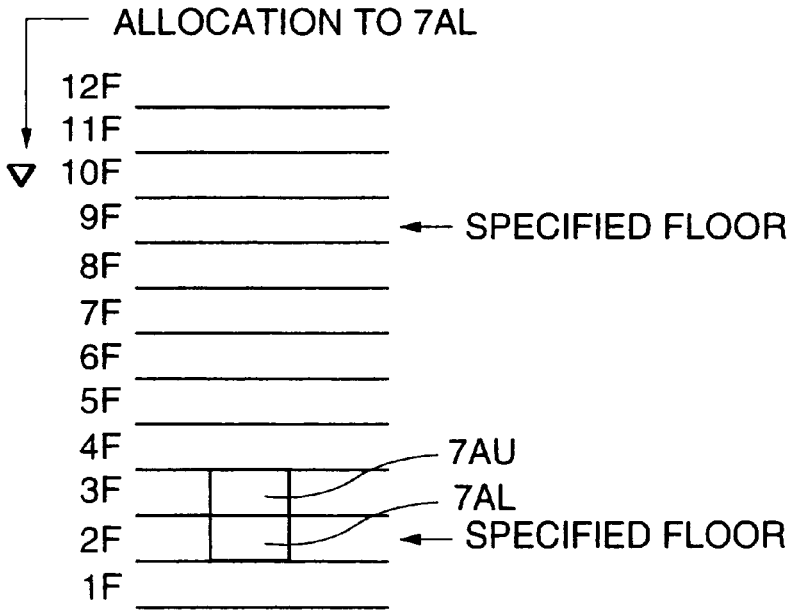

FIGS. 21A and 21B are explanatory diagrams each showing the operation control in a tenth embodiment of the present invention. In the tenth embodiment, a first specified floor of the specified floors between which the reciprocating elevator 7A reciprocates is constructed of only one specified floor 2F, and a second other specified floor is also constructed of only one specified floor 9F or 10F. When the elevator hall call to the specified floor is registered in the elevator hall call registering unit 4, the elevator hall call to the specified floor is allocated to any one of the upper and lower cages 7AU, 7AL. FIG. 21A shows a case where the elevator hall call to the other specified floor 9F is allocated to the upper cage 7AU located at one specified floor 2F. FIG. 21B shows a case in which the elevator hall call to the other specified floor 10F is allocated to the lower cage 7AL located at one specified floor 2F.

Referring to FIG. 21A, it is assumed that a single unit of A-elevator 7A be set as a reciprocating elevator, one specified floor be constructed of only one floor 2F, and the other specified floor be constructed of only one floor 9P. Then, the reciprocating elevator 7A is first, it is assumed, located at 1F and 2F as shown in FIG. 21A. Note that the cage call to the specified floor 9F is, it is assumed, registered in neither the upper cage 7AU nor the lower cage 7AL of the reciprocating elevator 7A.

In this state, supposing that the downward (DN) elevator hall call to the specified floor 9F is newly registered, the allocation control unit 5 allocates the elevator hall call to the specified floor 9F to the upper cage 7AU located at the specified floor 2F.

On the other hand, it is presumed that the upper and lower cages 7AU, 7AL of the reciprocating elevator 7A is first, as shown in FIG. 21B, initially located at 3F and 2F (the specified floors), and besides no cage call be registered. In this state, supposing that there is newly registered the downward (DN) elevator hall call to 10F above the specified floor 9F, the allocation control unit 5 allocates the 10F elevator hall call to the lower cage 7AL located at the floor 2F. Thus, the allocation control unit 5 allocates the elevator hall call to the specified floor by limiting this allocation to one of the upper and lower cages 7AU, 7AL.

In accordance with the tenth embodiment, when each of the one specified floor and the other specified floor is constructed of one floor, the call is allocated to only one predetermined cage with no possibility of using the other cage, whereby the useless halt can be obviated, and the usability to the user is enhanced.

Herein, when the upper or lower cage of the reciprocating elevator responds to the elevator hall call to the specified floor, the floor at which the other cage of the same elevator containing the cage having responded stops, is not the specified floor as the case may be. In this case, the door opening button in the other cage of the same elevator containing the cage having responded, is made ineffective.

For instance, as shown in FIG. 15A, assuming the downward (DN) elevator hall call to the specified floor 11F, and if this elevator hall call is allocated to the upper cage 7AU, it turns out that the lower cage 7AL halts at the floor other than the specified floors. Then, the cage controller 2A, when the upper cage 7AU responds to the above elevator hall call, makes ineffective the door opening button in the lower cage 7AL, because the floor 10F at which the lower cage 7AL stops is not the specified floor. With this contrivance, in a building where the specified floor is a restaurant floor, and other floors are office floors, it is feasible to inhibit the general persons from utilizing the floors excluding the specified floor.

Figure 22:
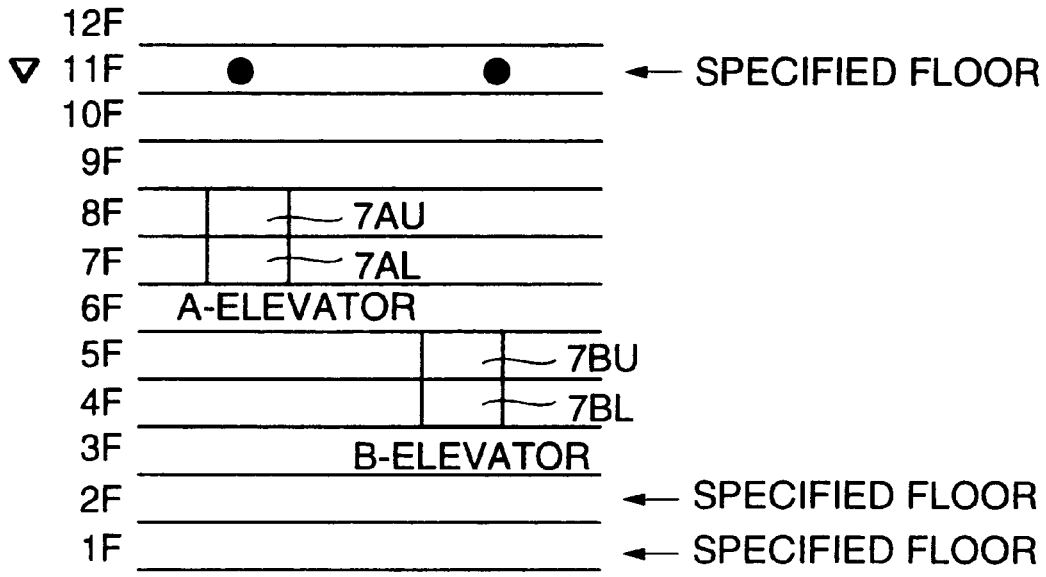
FIG. 22 is an explanatory diagrams showing the operation control in an eleventh embodiment of the present invention.

FIG. 22 is an explanatory diagram showing the operation control in an eleventh embodiment of the present invention. In the eleventh embodiment, if two or more reciprocating elevators are provided, the elevator hall call to the specified floor is registered in the elevator hall call registering unit 4. Then, when there are selected a plurality of cages to which the above elevator hall call is allocated, the allocation control unit 5 executes the predetermined evaluation arithmetic process with respect to the plurality of cages, and the elevator hall call to the specified floor is allocated to the cage exhibiting a high evaluation value.

In a case in which there are provided two or more reciprocating elevators reciprocating between the specified floors, when the elevator hall call to the specified floor is registered, the allocation control unit 5, as in the sixth through eleventh embodiments, detects a proper cage by performing peculiar control each time the reciprocating operation is carried out. Then, if the plurality of cages are detected, in the eleventh embodiment, the predetermined evaluation arithmetic process is implemented with respect to the plurality of detected cages, and the elevator hall call to the specified floor is allocated to the cage exhibiting the high evaluation value.

In the example shown in, e.g., FIG. 22, it is assumed that first specified floors be set to 1F and 2F, while a second other specified floor be set to 11F. Supposing that the cage call to the specified floor 11F is given to the upper cage 7AU of the A-elevator 7A and also to the lower cage 7BL of the B-elevator, the downward (DN) elevator hall call to the specified floor 11F is newly registered, in which case the cage call to 11F has already been allocated to the upper cage 7AU of the A-elevator 7A, and hence the upper cage 7AU of the A-elevator is at first registered in response to the above elevator hall call. It is presumed that the lower cage 7BL of the B-elevator will have responded to the 11F elevator hall call. Thus, when the cages 7AU, 7BL of the two elevators 7A, 7B have responded, the predetermined evaluation arithmetic process described above is executed with respect to these two cages 7AU, 7BL, and the elevator hall call to the specified floor 11F is allocated to the cage (e.g., the upper cage 7AU of the A-elevator) exhibiting the high evaluation value.

Figure 23:
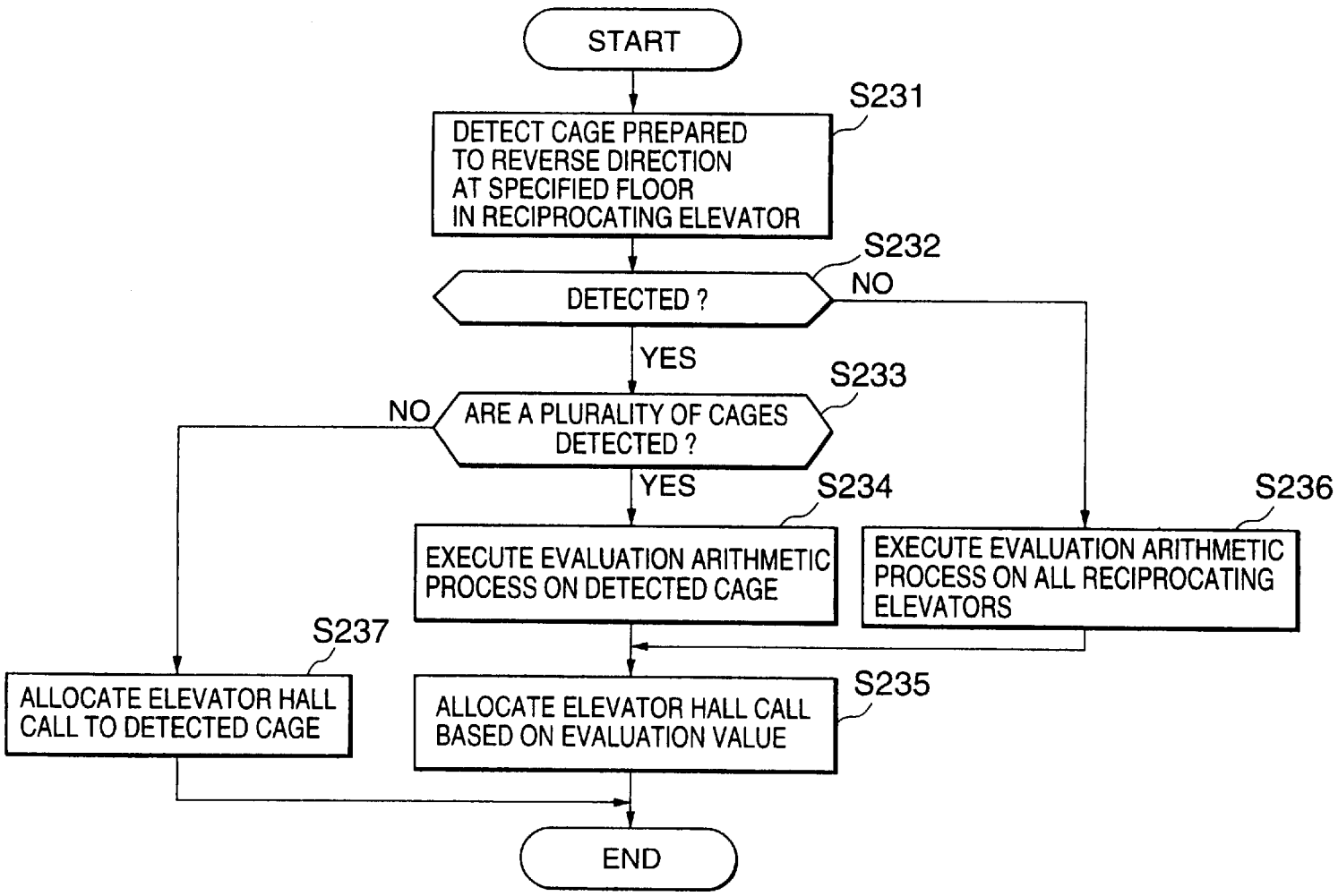
FIG. 23 is a flowchart showing the operation of the allocation control unit in the eleventh embodiment of the present invention.

FIG. 23 is a flowchart showing the operation of the allocation control unit 5 in the above case. The cage call to 11F (the specified floor) is registered in the upper cage 7AU of the A-elevator and also in the lower cage 7BL of the B-elevator. Herein, the cage controllers 2A, 2B of the A- and B-elevators transmit to the allocation control unit 5 pieces of call information (the upper cage of the A-elevator: 11.C), (the lower cage of the B-elevator: 11.C) held by the respective cages as cage information.

Now, supposing that the DN elevator hall call to 11F (the specified floor) is newly registered, on the basis of the elevator information described above, the allocation control unit 5 detects the upper cage 7AU of the A-elevator and the lower cage 7BL of the B-elevator among the cages of the A- and B-elevators, which are prepared to reverse their directions at the specified floors (steps S231, S232). If a plurality of cages (two cages) are detected (step S233), the predetermined evaluation arithmetic process is executed upon the detected upper and lower cages 7AU, 7BL of the A- and B-elevators, thereby calculating evaluation values (step S234).

Herein, it is assumed that the elevator hall call is allocated to the upper cage 7AU of the A-elevator on the basis of the evaluation values (step S235). In this case, a cage prediction arrival time till the newly registered elevator hall call may be used by way of one example of the index of the predetermined evaluation arithmetic process. Note that if there is no cage prepared to reverse its direction at the specified floor 11F, the predetermined evaluation arithmetic process is implemented upon the upper and lower cages of all the reciprocating elevators (step S236), and the allocation cage is determined based on these evaluation values. Further, if it is judged in step S233 that only one cage is detected, the elevator hall call is allocated to this detected cage.

In accordance with the eleventh embodiment, in the case of setting the plurality of reciprocating elevators, it is feasible to attain the control peculiar to the reciprocating operations in the sixth to eleventh embodiments.

The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A double deck elevator controlling apparatus for executing group supervisory control of a plurality of double deck elevators each contain upper and lower cages vertically connected to each other, said apparatus comprising:

elevator hall call registering means for registering elevator hall call buttons in up- and down-directions which are provided at respective elevator halls on respective floors;

allocation control means for making both of the upper and lower cages respond to an elevator hall call to a specified floor which meets a predetermined condition during an operation in a double operating mode of giving services of the upper cages in response to the elevator hall calls at even-numbered floor and giving services of the lower cages in response to the elevator hall calls at odd-numbered floors;

cage call registering means provided for each of said double deck elevators and for making it possible to register the cage calls of both of the upper and lower cages during the operation in the double operation mode as far as the specified floor is concerned;

operation control means for operating the upper and lower cages so as to respond to the elevator hall call to the specified floor which is allocated by said allocation control unit and to the cage call to the specified floor which is registered in said cage call registering means; and elevator hall notifying means for, if there exist both of the elevator hall call to the specified floor which is allocated by said allocation control means and the cage call to the specified floor which is registered in said cage call registering means, and when responding to the elevator hall call by reversing a direction at the specified floor, prompting passengers at an elevator hall on the specified floor when a head cage arrives responding to the cage call to board ahead, although the cage temporarily travels in an opposite direction to let the passengers of the other cage get off.

2. A double deck elevator controlling apparatus according to claim 1, wherein each floor is provided with a car approaching display lamp for giving, during the operation in the double operation mode, a notification that the cage goes to the even-numbered floor when the upper cage arrives at the specified floor, and a notification that the cage goes to the odd-numbered floor when the lower cage arrives thereat.

3. A double deck elevator controlling apparatus according to claim 1, further comprising:

an elevator hall door closing button for closing a door of said elevator and prompting said elevator to start off for the passengers at the elevator hall on the specified floor.

4. A double deck elevator controlling apparatus for executing group supervisory control of a plurality of double deck elevators each containing upper and lower cages vertically connected to each other, said apparatus comprising:

elevator hall call registering means for registering elevator hall call buttons in up- and down-directions which are provided at respective elevator halls on respective floors;

allocation control means for making both of the upper and lower cages respond to an elevator hall call to a specified floor which meets a predetermined condition during an operation in a double operation mode of giving services of the upper cages in response to the elevator hall calls at even-numbered floors and giving services of the lower cages in response to the elevator hall calls at odd-numbered floors;

cage call registering means provided for each of said double deck elevators and for making it possible to register the cage calls of both of the upper and lower cages during the operation in the double operation mode as far as the specified floor is concerned; and operation control means for operating the upper and lower cages so as to respond to the elevator hall call to the specified floor which is allocated by said allocation control unit and to the cage call to the specified floor which is registered in said cage call registering means;

wherein said operation control means, if there exist both of the elevator hall call to the specified floor which is allocated by said allocation control means and the cage call to the specified floor which is registered in said cage call registering means, makes the cage respond ahead to an upper cage call in the case of the elevator hall call in the up-direction, and makes the cage respond ahead to a lower cage call in the case of the elevator hall call in the down-direction.

5. A double deck elevator controlling apparatus according to claim 4, wherein each floor is provided with a car approaching display lamp for giving, during the operation in the double operation mode, a notification that the cage goes to the even-numbered floor when the upper cage arrives at the specified floor, and a notification that the cage goes to the odd-numbered floor when the lower cage arrives thereat.

6. A double deck elevator controlling apparatus according to claim 4, further comprising:

an elevator hall door closing button for closing a door of said elevator and prompting said elevator to start off for the passengers at the elevator hall on the specified floor.

7. A double deck elevator controlling apparatus, for executing group supervisory control of a plurality of double deck elevators each contain upper and lower cages vertically connected to each other, said apparatus comprising:

elevator hall call registering means for registering elevator hall call buttons in up- and down-directions which are provided at respective elevator halls on respective floors;

allocation control means for making both of the upper and lower cages respond to an elevator hall call to a specified floor which meets a predetermined condition during an operation in a double operation mode of giving services of the upper cages in response to the elevator hall calls at even-numbered floors and giving services of the lower cages in response to the elevator hall calls at odd-numbered floors;

cage call registering means provided for each of said double deck elevators and for making it possible to register the cage calls of both of the upper and lower cages during the operation in the double operation mode as far as the specified floor is concerned;

operation control means for operating the upper and lower cages so as to respond to the elevator hall call to the specified floor which is allocated by said allocation control unit and to the cage call to the specified floor which is registered in said cage call registering means; and an alternative cage door closing button, provided in each of the upper and lower cages, for closing the door of the alternative cage and prompting the elevator to start off when the alternative cage halts at the elevator hall on the specified floor and opens its door.

8. A double deck elevator controlling apparatus according to claim 7, wherein each floor is provided with a car approaching display lamp for giving, during the operation in the double operation mode, a notification that the cage goes to the even-numbered floor when the upper cage arrives at the specified floor, and a notification that the cage goes to the odd-numbered floor when the lower cage arrives thereat.

9. A double deck elevator controlling apparatus according to claim 7, further comprising:

an elevator hall door closing button for closing a door of said elevator and prompting said elevator to start off for the passengers at the elevator hall on the specified floor.

10. A double deck elevator controlling apparatus for executing group supervisory control of a plurality of double deck elevators each containing upper and lower cages vertically connected to each other, one of said plurality of double deck elevators being set as a reciprocating elevator reciprocating between specified floors, traveling of said reciprocating elevator being controlled between first specified floors of two consecutive floors and a second specified floor of only one floor, said apparatus comprising:

elevator hall call registering means for registering elevator hall calls to the respective floors including the specified floors;

allocation control means for allocating the elevator hall call to the specified floor to the upper or lower cage, with a cage call to the specified floor, of said reciprocating elevator when the elevator hall call to the specified floor is registered in said elevator hall call registering means, executing a predetermined arithmetic process upon the upper cage and the lower cage when there is no cage call to the specified floor, and allocating the elevator hall call to cage exhibiting a high evaluation value; and operation control means provided in each of said elevators, for controlling the traveling of the cage so as to respond to the call allocated by said allocation control means;

wherein said allocation control means allocates the elevator hall call to the upper cage of said reciprocating elevator when the elevator hall call to the upper floor of the specified floors is registered in said elevator hall call registering means, and allocates the elevator hall call to the lower cage of said reciprocating elevator when the elevator hall call to the lower floor of the specified floors is registered in said elevator hall registering means.

11. A double deck elevator controlling apparatus for executing group supervisory control of a plurality of double deck elevators each containing upper and lower cages vertically connected to each other, one of said plurality of double deck elevators being set as a reciprocating elevator reciprocating between specified floors, traveling of said reciprocating elevator being controlled between first specified floors of two consecutive floors and a second specified floor of only one floor, said apparatus comprising:

elevator hall call registering means for registering elevator hall calls to the respective floors including the specified floors;k allocation control means for allocating the elevator hall call to the specified floor to the upper or lower cage, with a cage call to the specified floor, of said reciprocating elevator when the elevator hall call to the specified floor is registered in said elevator hall call registering means, executing a predetermined arithmetic process upon the upper cage and the lower cage when there is no cage call to the specified floor, and allocating the elevator hall call to the cage exhibiting a high evaluation value;

operation control means, provided in each of said elevators, for controlling the traveling of the cage so as to respond to the call allocated by said allocation control means; and means for, if a floor at which the alternative cage of said reciprocating elevator is not the specified floor when said operation control means controls the operation so that the upper cage or the lower cage of said reciprocating elevator responds to the elevator hall call to the specified floor, making ineffective an operation of closing the door, through the door opening button within the alternative cage of said same elevator, of the cage having responded.

* * * * *